US011381000B2

(12) United States Patent
You et al.

(10) Patent No.: US 11,381,000 B2
(45) Date of Patent: Jul. 5, 2022

(54) LOW-SIDELOBE PLATE ARRAY ANTENNA

(71) Applicant: Ningbo University, Zhejiang (CN)

(72) Inventors: Yang You, Zhejiang (CN); Jifu Huang, Zhejiang (CN); Ling Zhang, Zhejiang (CN); Qingchun You, Zhejiang (CN); Yunlong Lu, Zhejiang (CN)

(73) Assignee: Ningbo University, Zhejiang (CN)

( * ) Notice: Subject to any disclaimer, the term of this patent is extended or adjusted under 35 U.S.C. 154(b) by 64 days.

(21) Appl. No.: 17/114,402

(22) Filed: Dec. 7, 2020

(65) Prior Publication Data

US 2021/0359420 A1 Nov. 18, 2021

(30) Foreign Application Priority Data

May 18, 2020 (CN) ..... 202010417832.9

(51) Int. Cl.

| | |
|---|---|
| ***H01Q 15/00*** | (2006.01) |
| ***H01Q 1/38*** | (2006.01) |
| ***H01Q 21/00*** | (2006.01) |
| ***H01Q 21/06*** | (2006.01) |
| ***H01Q 25/02*** | (2006.01) |

(52) U.S. Cl.

CPC ..... *H01Q 15/0053* (2013.01); *H01Q 1/38* (2013.01); *H01Q 21/0031* (2013.01); *H01Q 21/061* (2013.01); *H01Q 25/02* (2013.01)

(58) Field of Classification Search

CPC .. H01Q 15/0053; H01Q 1/38; H01Q 21/0031; H01Q 21/061; H01Q 21/064; H01Q 1/36; H01Q 1/50; H01Q 13/10; H01Q 13/18

See application file for complete search history.

(56) References Cited

FOREIGN PATENT DOCUMENTS

| | | | | |
|---|---|---|---|---|
| CN | 205069859 U | * | 3/2016 | ..... H01Q 1/38 |
| CN | 107342454 | | 11/2017 | |
| CN | 111585050 B | * | 3/2021 | ..... H01P 5/181 |

* cited by examiner

*Primary Examiner* — Hoang V Nguyen
(74) *Attorney, Agent, or Firm* — JCIPRNET

(57) ABSTRACT

A low-sidelobe plate array antenna includes a radiation layer and a feed layer. The radiation layer is superimposed on the feed layer and includes a first plate and a radiation array disposed on the first plate. The radiation array is formed by $n^2$ radiation units which are distributed in $2^{(k-1)}$ rows and $2^{(k-1)}$ columns. Each radiation unit in the radiation layer is constituted by two first radiation assemblies and two second radiation assemblies. Each first radiation assembly comprises a first rectangular bar, a first rectangular cavity, a second rectangular cavity and a third rectangular cavity. The first rectangular cavity, the second rectangular cavity and the third rectangular cavity in the first radiation assembly are stacked in presence of an azimuth deviation to form a three-layer coupled structure, and the first rectangular bar located in the first rectangular cavity can better restrain cross polarization and reduce the sidelobe.

3 Claims, 6 Drawing Sheets

LOW-SIDELOBE PLATE ARRAY ANTENNA

CROSS-REFERENCE TO RELATED APPLICATION

This application claims the priority benefit of China application serial no. 202010417832.9, filed on May 18, 2020. The entirety of the above-mentioned patent application is hereby incorporated by reference herein and made a part of this specification.

TECHNICAL FIELD

The invention relates to a plate array antenna, in particular to a low-sidelobe plate array antenna.

DESCRIPTION OF RELATED ART

In recent years, high-performance array antennas which have a high sensitivity, a wide band, a low profile and a low sidelobe and characterized by multiple frequency bands and low costs have been widely used in the fields of radar, communication, remote sensing and metering, and spatial technology. Existing common array antennas mainly include micro-strip array antennas and plate array antennas.

The micro-strip array antennas are featured by low profile, low cost and low weight and are easy to machine. However, when the frequency or antenna array size increases, the insertion loss will be increased due to conductor losses and dielectric losses of the micro-strip array antennas. Thus, the micro-strip array antennas can fulfill a wide band, but cannot fulfill high frequency, high efficiency or high gain.

Waveguide slot array antennas are mainstream plate array antennas used at present and are designed in such a manner that one or more slots are formed in the conductor wall of a waveguide to cut off a current line on the inner wall, part of the current across the surface of the inner wall of the waveguide bypasses the slots, the other part of the current flows across the slots in the original direction in a form of displacement current, and radiation is realized by power lines at the openings of the slots. The waveguide slot array antennas have the properties of low conductor loss, high efficiency, high performance and the like. Existing waveguide slot array antennas include waveguide slot traveling wave array antennas and waveguide slot standing wave array antennas. However, the beam direction of the waveguide slot traveling wave array antennas varies with the frequency, which results in inconsistent directions of antenna beams within a wideband range, and the waveguide slot traveling wave array antennas can only be used within an extremely narrow bandwidth, and the frequency band cannot be expanded. Because the waveguide slot standing wave array antennas are resonance antennas essentially, once the frequency deviates from the resonance frequency, the performance indicators such as the directional diagram and the sidelobe level will deteriorate drastically, so that the waveguide slot standing wave array antennas can only be used within a narrow frequency band and have a bandwidth in inverse proportion to the size of the array antennas.

To comply with the ever higher anti-interference requirement for radar and the development of the modern electronic industry, the antennas should have a low or extremely low sidelobe. As for traditional waveguide slot array antennas which mainly include a feed layer and a radiation layer, there are principally two solutions for reducing the sidelobe of the traditional waveguide slot array antennas at present. According to the first solution, the power distribution proportion of the feed layer is controlled to adjust the energy distribution of the radiation layer to reduce the sidelobe; however, when this solution is used to reduce the sidelobe, the main lobe will become wider, the gain will be decreased, and it is impossible to gain an extremely low sidelobe under the condition where a narrow main lobe is guaranteed and the gain is not sacrificed. According to the second solution, a polarization layer is arranged on the radiation layer to reduce the sidelobe; the polarization layer can change the polarization direction of an electric field of the radiation layer to optimize the directional diagrams of the E-plane and the H-plane of the antennas, thus obtaining a low sidelobe. However, due to the addition of the polarization layer, the cost of the antennas may be increased by 20% during mass production.

Chinese Invention Patent Application No. 201710429885.0 discloses a waveguide slot array antenna which comprises a radiation layer and feed layer which are arranged from top to bottom, wherein the radiation layer is constituted by a multi-layer coupled structure composed of a first radiation unit, a second radiation unit, a third radiation unit and a fourth radiation unit which are stacked from bottom to top. This waveguide slot array antenna has a wide band, a high gain and a low sidelobe, but has the following problems: 1, the radiation layer has too many structure layers which cannot be processed one by one, the assembly structure is complicated, so that mass production is unavailable; 2, the radiation layer adopts a coupling cavity divided into four parts, so that the relative bandwidth is narrow, and a wider frequency bandwidth cannot be obtained; 3, the low-sidelobe property is realized by means of repeated rotation of the several radiation units in the radiation layer, so that the efficiency of the antennas is reduced.

BRIEF SUMMARY OF THE INVENTION

The technical issue to be settled by the invention is to provide a low-sidelobe plate array antenna, which has a low sidelobe, is simple in structure, low in cost and suitable for mass production, and has a wide frequency bandwidth and high efficiency.

The technical solution adopted by the invention to settle the aforesaid technical issue is as follows: a low-sidelobe plate array antenna comprises a radiation layer and a feed layer, wherein the radiation layer is superimposed on the feed layer, the feed layer is used to output $4*n^2$ TE10 mode signals, the radiation layer has $4*n^2$ input terminals and $4*n^2$ output terminals, the $4*n^2$ TE10 mode signals output by the feed layer are accessed to the $4*n^2$ input terminals of the radiation layer in a one-to-one correspondence, the $4*n^2$ output terminals of the radiation layer are used to radiate the $4*n^2$ TE10 mode signals output by the feed layer to a free space in a one-to-one correspondence, $n=2^{(k-1)}$, and k is an integer greater than or equal to 3; the radiation layer comprises a first plate and a radiation array disposed on the first plate, wherein the first plate is a rectangular plate, the radiation array is formed by $n^2$ radiation units which are distributed in $2^{(k-1)}$ rows and $2^{(k-1)}$ columns, a center distance between every two adjacent radiation unit in each row is 1.8λ, a center distance between every two adjacent radiation units in each column is 1.8λ, and λ=c/f, wherein c is a wave velocity, c=3*10ˆ8 m/s, and f is a center operating frequency of the low-sidelobe plate array antenna; each radiation unit comprises two first radiation assemblies and two second radiation assemblies, wherein the two first radiation assemblies are parallelly arranged left and right and are spaced apart from each other, the first radiation assembly on the left will overlap with the first radiation assembly on the right after being moved rightwards by 0.9λ, the two second radiation assemblies are also arranged left and right and are spaced apart from each other, the second radiation assembly on the left will overlap with the second radiation assembly on the right after being moved rightwards by 0.9λ, the two second radiation assemblies are located behind the two first radiation assemblies, a center distance between the second radiation assembly on the left and the first radiation assembly on the left is 0.9λ, and a center distance between the second radiation assembly on the right and the first radiation assembly on the right is 0.9λ.

Each first radiation assembly comprises a first rectangular bar, a first rectangular cavity, a second rectangular cavity and a third rectangular cavity, wherein the first rectangular cavity, the second rectangular cavity and the third rectangular cavity are sequentially arranged from top to bottom, a center of the first rectangular bar, a center of the first rectangular cavity, a center of the second rectangular cavity and a center of the third rectangular cavity are located on the same line which is perpendicular to the first plate and is referred to as a center line, the first rectangular bar is located in the first rectangular cavity, an upper end surface of the first rectangular bar and an upper end surface of the first rectangular cavity are located on the same plane as an upper end surface of the first plate, a front end surface of the first rectangular bar and a front end surface of the first rectangular cavity are formed and connected integrally and are attached together, a rear end surface of the first rectangular bar and a rear end surface of the first rectangular cavity are formed and connected integrally and are attached together; if the first rectangular cavity is rotated anticlockwise by 45° around the center line, a plane where the front end surface of the first rectangular cavity is located will be parallel to a plane where the front end surface of the first plate is located, and a plane where a front end surface of the second rectangular cavity is located will be parallel to a plane where a front end surface of the third rectangular cavity is located; if the second rectangular cavity is rotated anticlockwise by 67.5° around the center line, a plane where the front end surface of the second rectangular cavity is located will be parallel to a plane where the front end surface of the first plate is located, an upper end surface of the second rectangular cavity will be located on the same plane as a lower end surface of the first rectangular cavity, an upper end surface of the third rectangular cavity will be located on the same plane as a lower end surface of the second rectangular cavity, a lower end surface of the third rectangular cavity will be located on the same plane as a lower end surface of the first plate, a distance from a left end surface of the first rectangular bar to a left end surface of the first rectangular cavity is equal to a distance from a right end surface of the first rectangular bar to a right end surface of the first rectangular cavity, a distance from the front end surface to the rear end surface of the first rectangular cavity is 0.8λ, a distance from the left end surface to the right end surface of the first rectangular cavity is 0.6λ, a distance from the upper end surface to the lower end surface of the first rectangular cavity is 0.3λ, a distance from the left end surface to the right end surface of the first rectangular bar is 0.1λ, and a distance from the upper end surface to the lower end surface of the first rectangular bar is 0.1λ; a distance from the front end surface to the rear end surface of the second rectangular cavity is 0.6λ, a distance from the left end surface to the right end surface of the second rectangular cavity is 0.4λ, and a distance from the upper end surface to the lower end surface of the second rectangular cavity is 0.3λ.

A first rectangular matching plate and a second rectangular matching plate are arranged in the second rectangular cavity, a left side wall of the first rectangular matching plate and a left side wall of the second rectangular cavity are attached together and are formed and connected integrally, a distance from a front end surface of the first rectangular matching plate to a front end surface of the second rectangular cavity is equal to a distance from a rear end surface of the first rectangular matching plate to a rear end surface of the second rectangular cavity, a distance from a left end surface to a right end surface of the first rectangular matching plate is 0.1λ, a distance from a front end surface to a rear end surface of the first rectangular matching plate is 0.2λ.

An upper end surface of the first rectangular matching plate is located on the same plane as the upper end surface of the second rectangular cavity, a lower end surface of the first rectangular matching plate is located on the same plane as the lower end surface of the second rectangular cavity, and the second rectangular matching plate and the first rectangular matching plate are symmetrical left and right with respect to a left-right bisecting plane of the second rectangular cavity.

A distance from the front end surface to the rear end surface of the third rectangular cavity is 0.4λ, a distance from the left end surface to the right end surface of the third rectangular cavity is 0.2λ, a distance from the upper end surface to the lower end surface of the third rectangular cavity is 0.1λ, a third rectangular matching plate is arranged in the third rectangular cavity, a left side wall of the third rectangular matching plate and a left side wall of the third rectangular cavity are attached together and are formed and connected integrally, a distance from a front end surface of the third rectangular matching plate to the front end surface of the third rectangular cavity is equal to a distance from a rear end surface of the third rectangular matching plate to the rear end surface of the third rectangular cavity, an upper end surface of the third rectangular matching plate is located on the same plane as the upper end surface of the third rectangular cavity, a lower end surface of the third rectangular matching plate is located on the same plane as the lower end surface of the third rectangular cavity, a distance from a left end surface to a right end surface of the third rectangular matching plate is 0.1λ, a distance from a front end surface to a rear end surface of the third rectangular matching plate is 0.2λ, the upper end surface of the first rectangular cavity is used as an output terminal of the first radiation assembly, and the lower end surface of the third rectangular cavity is used as an input terminal of the first radiation assembly.

If the first radiation assembly on the left is moved downwards by 0.9λ and is then rotated clockwise by 180° around the center line, the first radiation assembly on the left will overlap with the second radiation assembly on the left; if the first radiation assembly on the right is moved downwards by 0.9λ and is then rotated clockwise by 180° around the center line, the first radiation assembly on the right will overlap with the second radiation assembly on the right.

The input terminals of the two first radiation assemblies and input terminals of the two second radiation assemblies are used as four input terminals of the radiation unit; the four input terminals of each radiation unit are used as four input terminals of the radiation layer, and the radiation layer has $4*n^2$ input terminals; the output terminals of the two first radiation assemblies and output terminals of the two second radiation assemblies are used as four output terminals of the radiation unit, the four output terminals of each radiation unit are used as four output terminals of the radiation layer, and the radiation layer has $4*n^2$ output terminals.

The feed layer comprises a second plate, $$\left(\frac{n}{2^1}\right)^2$$

first-level H-type E-plane waveguide power division network units and a standard waveguide input port, wherein the $$\left(\frac{n}{2^1}\right)^2$$

first-level H-type E-plane waveguide power division network units and the standard waveguide input port are disposed on the second plate, and the second plate is a rectangular plate; each first-level H-type E-plane waveguide power division network unit comprises a first-level H-type E-plane waveguide power division network and a second-level H-type E-plane waveguide power divider, wherein the first-level H-type E-plane waveguide power division network comprises two first H-type E-plane waveguide power division networks and two second H-type E-plane waveguide power division networks, the two first H-type E-plane waveguide power division networks are parallelly arranged left and right and are spaced apart from each other, the first H-type E-plane waveguide power division network on the left will overlap with the first H-type E-plane waveguide power division network on the right after being moved rightwards by 1.8λ, the two second H-type E-plane waveguide power division networks are arranged left and right and are spaced apart from each other, the second H-type E-plane waveguide power division network on the left will overlap with the second H-type E-plane waveguide power division network on the right after being moved rightwards by 1.8λ, the two second H-type E-plane waveguide power division networks are located behind the two first H-type E-plane waveguide power division networks, a center distance between the second H-type E-plane waveguide power division network on the left and the first H-type E-plane waveguide power division network on the left is 1.8λ, the second H-type E-plane waveguide power division network on the left and the first H-type E-plane waveguide power division network on the left are symmetrical front and back, a center distance between the second H-type E-plane waveguide power division network on the right and the first H-type E-plane waveguide power division network on the right is 1.8λ, and the second H-type E-plane waveguide power division network on the right and the first H-type E-plane waveguide power division network on the right are symmetrical front and back.

Each first H-type E-plane waveguide power division network comprises a first-level H-type E-plane waveguide power divider and four E-plane rectangular waveguide-single ridge waveguide transducers, wherein the first-level H-type E-plane waveguide power divider has an input terminal and four output terminals, divides a signal input via the input terminal thereof into four signals with the same power and phase, and outputs the four signals via the four output terminals thereof respectively, each E-plane rectangular waveguide-single ridge waveguide transducer has an input terminal and an output terminal and is used to convert a rectangular waveguide accessed to the input terminal thereof into a single ridge waveguide and output the single ridge waveguide via the output terminal thereof, the input terminals of the four E-plane rectangular waveguide-single ridge waveguide transducers are connected to the four output terminals of the first-level H-type E-plane waveguide power divider in a one-to-one correspondence, the input terminal of the first-level H-type E-plane waveguide power divider is used as an input terminal of the first H-type E-plane waveguide power division network, the output terminal of each E-plane rectangular waveguide-single ridge waveguide transducer is used as an output terminal of the first H-type E-plane waveguide power division network, and the first H-type E-plane waveguide power division network has one input terminal and four output terminals;

the input terminals of the two first H-type E-plane waveguide power division networks and input terminals of the two second H-type E-plane waveguide power division networks are used as input terminals of the first-level H-type E-plane waveguide power division network, four output terminals of each of the two first H-type E-plane waveguide power division networks and four output terminals of each of the two second H-type E-plane waveguide power division networks are used as output terminals of the first-level H-type E-plane waveguide power division network, and the first-level H-type E-plane waveguide power division network has four input terminals and sixteen output terminals;

the second-level H-type E-plane waveguide power divider has an input terminal and four output terminals and is used to divide a signal input via the input terminal thereof into four signals with the same power and phase and output the four signals via the four output terminals thereof respectively, the input terminal of the second-level H-type E-plane waveguide power divider is used as an input terminal of the first-level H-type E-plane waveguide power division network unit, the four output terminals of the second-level H-type E-plane waveguide power divider are connected to the four input terminals of the first-level H-type E-plane waveguide power division network in a one-to-one correspondence, the sixteen output terminals of the first-level H-type E-plane waveguide power division network are used as sixteen output terminals of the first-level H-type E-plane waveguide power division network unit, and the $$\left(\frac{n}{2^1}\right)^2$$

first-level H-type E-plane waveguide power division network units have $$16*\left(\frac{n}{2^1}\right)^2$$

output terminals, and the $$16*\left(\frac{n}{2^1}\right)^2$$

output terminals of the $$\left(\frac{n}{2^1}\right)^2$$

first-level H-type E-plane waveguide power division network units are used as $$16*\left(\frac{n}{2^1}\right)^2$$

output terminals of the feed layer and are connected to the $4*n^2$ input terminals of the radiation layer in a one-to-one correspondence; the $$\left(\frac{n}{2^1}\right)^2$$

first-level H-type E-plane waveguide power division network units are regularly distributed in $$\frac{n}{2^1}$$

rows and $$\frac{n}{2^1}$$

columns at intervals to form a first-level feed network array, a center distance between every two adjacent first-level H-type E-plane waveguide power division network units in each row is 3.6λ, and a center distance between every two adjacent first-level H-type E-plane waveguide power division network units in each column is 3.6λ;

from the first row and the first column of the first-level feed network array, the four first-level H-type E-plane waveguide power division network units in every two rows and every two columns form a first-level network unit group, and the first-level feed network array totally includes $$\left(\frac{n}{2^2}\right)^2$$

first-level network unit groups;

a third-level H-type E-plane waveguide power divider is disposed in each first-level network unit group, has an input terminal and four output terminals, and is used to divide a signal input via the input terminal thereof into four signals with the same power and phase via the four output terminals thereof respectively, the four output terminals of the third-level H-type E-plane waveguide power divider are connected to the input terminals of the four first-level H-type E-plane waveguide power division network units in the first-level network unit group in a one-to-one correspondence, the first-level network unit group and the third-level H-type E-plane waveguide power divider connected thereto form a second-level H-type E-plane waveguide power division network unit, the input terminal of the third-level H-type E-plane waveguide power divider is used as an input terminal of the second-level H-type E-plane waveguide power division network unit, $$\left(\frac{n}{2^2}\right)^2$$

second-level H-type E-plane waveguide power division network units which are distributed in $$\frac{n}{2^2}$$

rows and $$\frac{n}{2^2}$$

columns are obtained in total, and the $$\left(\frac{n}{2^2}\right)^2$$

second-level H-type E-plane waveguide power division network units form a second-level feed network array;

from the first row and the first column of the second-level feed network array, the four second-level H-type E-plane waveguide power division network units in every two rows and every two columns form a second-level network unit group, the second-level feed network array totally includes $$\left(\frac{n}{2^3}\right)^2$$

second-level network unit groups, the input terminal of the third-level H-type H-plane waveguide power divider of each second-level H-type E-plane waveguide power division network unit in the second-level network unit group is used as an input terminal of the second-level network unit group, and the second-level network unit group has four input terminals; a fourth-level H-type E-plane waveguide power divider is disposed in each second-level network unit group, has an input terminal and four output terminals, and is used to divide a signal input via the input terminal thereof into four output signals with the same power and phase and output the four signals via the four output terminals thereof respectively, the four output terminals of the fourth-level H-plane E-plane waveguide power divider are connected to the four input terminals of the second-level network unit group in a one-to-one correspondence, the second-level network unit group and the fourth-level H-type E-plane waveguide power divider connected thereto form a third-level H-type E-plane waveguide power division network unit, the input terminal of the fourth-level H-type E-plane waveguide power divider is used as an input terminal of the third-level H-type E-plane waveguide power division network unit, $$\left(\frac{n}{2^3}\right)^2$$

third-level H-type E-plane waveguide power division network units which are distributed in $$\frac{n}{2^3}$$

rows and $$\frac{n}{2^3}$$

columns are obtained in total, and the $$\left(\frac{n}{2^3}\right)^2$$

third-level H-type E-plane waveguide power division network units form a third-level feed network array;

by this analogy, a $(k-2)^{th}$-level feed network array is formed by $$\left(\frac{n}{2^{k-2}}\right)^2$$

$(k-2)^{th}$-level H-type E-plane waveguide power division network units, a $(k-1)^{th}$-level H-type E-plane waveguide power divider is arranged among the four $(k-2)^{th}$-level H-type E-plane waveguide power division network units in the $(k-2)^{th}$-level feed network array, has an input terminal and four output terminals, and is used to divide a signal input via the input terminal thereof into four signals with the same power and phase and output the four signals via the output terminals thereof respectively, the four output terminals of the $(k-1)^{th}$-level H-type E-plane waveguide power divider are connected to the input terminals of the four $(k-2)^{th}$-level H-type E-plane waveguide power division network units in a one-to-one correspondence, the input terminal of the $(k-1)^{th}$-level H-type E-plane waveguide power divider is connected to the standard waveguide input port which is used as an input terminal of the feed layer, and the input terminal of the feed layer is connected to an external signal interface;

the first-level H-type E-plane waveguide power divider comprises a first conversion block, a second conversion block, a third conversion block, a fourth conversion block, a fifth conversion block, a sixth conversion block, a first rectangular block, a first metal block, a second metal block and a third metal block, wherein an upper end surface of the first conversion block, an upper end surface of the second conversion block, an upper end surface of the third conversion block, an upper end surface of the fourth conversion block, an upper end surface of the fifth conversion block, an upper end surface of the sixth conversion block, an upper end surface of the first rectangular block, an upper end surface of the first metal block, an upper end surface of the second metal block and an upper end surface of the third metal block are located on the same plane as an upper end surface of the second plate; a lower end surface of the first conversion block, a lower end surface of the second conversion block, a lower end surface of the third conversion block, a lower end surface of the fourth conversion block, a lower end surface of the fifth conversion block, a lower end surface of the sixth conversion block, a lower end surface of the first rectangular block, a lower end surface of the first metal block, a lower end surface of the second metal block and a lower end surface of the third metal block are located on the same plane as a lower end surface of the second plate;

the first metal block is a parallelogram block, a front end surface of the first metal block is parallel to a front end surface of the second plate, a left end surface of the first metal block will be parallel to a left end surface of the second plate after the first metal block is rotated anticlockwise by 22.5° around a center thereof, a length of the front end surface of the first metal block in the left-right direction is 0.12, length of the front end face of the first metal block in the front-back direction is 0.5λ, the length of the first metal block in the vertical direction is 0.8λ, and the first metal block will overlap with the second metal block after being moved rightwards by 0.9λ; the third metal block is located between the first metal block and the second metal block and is a parallelogram block, a front end face of the third metal block will be parallel to the front end face of the second plate after the third metal block is rotated clockwise by 12.5° around the center thereof, and the length of the front end face of the third metal block in the left-right direction is 0.6λ; the first conversion block comprises a second rectangular block and a first right triangle block, a left end face of the second rectangular block serves as a left end face of the first conversion block, the left end face of the first conversion block is connected and attached to a right end face of the first metal block, the length of a front end face of the second rectangular block in the left-right direction is 0.1λ, the length of the left end face of the second rectangular block in the front-back direction is 0.2λ, the distance from the front end surface of the second rectangular block to a front end surface of the first metal block will be equal to a distance from a rear end surface of the second rectangular block to a rear end surface of the first metal block after the second rectangular block is rotated anticlockwise by 22.5° around a center thereof, an end surface, where a first right-angle side of the first right triangle block is located, is connected and attached to a right end surface of the second rectangular block, a length of the end surface, where the first right-angle side of the first right triangle block is located, in the front-back direction is equal to a length of the left end surface of the second rectangular block in the front-back direction, an end surface, where a second right-angle side of the first right triangle block is located, is located on the same plane as the rear end surface of the second rectangular block, an included angle between the end surface where the first right-angle side of the first right triangle block is located and an end surface where a hypotenuse of the first right triangle block is located is 22.5°, and the end surface, where the hypotenuse of the first right triangle block is located, is connected to and entirely overlaps with a left end surface of the third metal block;

the second conversion block comprises a third rectangular block and a second right triangle block, wherein a right end surface of the third rectangular block serves as a right end surface of the second conversion block, the right end surface of the second conversion block is connected and attached to a left end surface of the second metal block, a length of a front end surface of the third rectangular block in the left-right direction is 0.1λ, a length of the right end surface of the third rectangular block in the front-back direction is 0.2λ, a distance from the front end surface of the third rectangular block to a front end surface of the second metal block is equal to a distance from a rear end surface of the third rectangular block to a rear end surface of the second metal block after the third rectangular block is rotated anticlockwise by 22.5° around a center thereof, an end surface, where a first right-angle side of the second right triangle block is located, is connected and attached to a left end surface of the third rectangular block, a length of the end surface, where the first right-angle side of the second right triangle block is located, in the front-back direction is equal to a length of the left end surface of the third rectangular block in the front-back direction, an end surface, where a second right-angle side of the second right triangle block is located, is located on the same plane as the front end surface of the third rectangular block, an included angle between the end surface where the second right-angle side of the second right triangle block is located and an end surface where a hypotenuse of the second right triangle block is located is 22.5°, and the end surface, where the hypotenuse of the second right triangle block is located, will be connected to and entirely overlap with a right end surface of the third metal block;

the third conversion block comprises a fourth rectangular block and a third right triangle block, wherein a front end surface of the fourth rectangular block serves as a front end surface of the third conversion block, a length of the front end surface of the fourth rectangular block in the left-right direction is 0.1λ, an end surface, where a first right-angle side of the third right triangle block is located, entirely overlaps with a rear end surface of the fourth rectangular block, a length of the end surface, where the first right-angle side of the third right triangle block is located, is equal to a length of the rear end surface of the fourth rectangular block in the left-right direction, an end surface, where a second right-angle side of the third right triangle block is located, is located on the same plane as a right end surface of the fourth rectangular block, an included angle between the end surface where the first right-angle side of the third right triangle block is located and an end surface where a hypotenuse of the third right triangle block is located is 22.5°, the end surface, where the hypotenuse of the third right triangle block is located, will be connected to and entirely overlap with the front end surface of the first metal block, the third conversion block will entirely overlap with the fourth conversion block after being moved rightwards by 0.9λ, and the rear end surface of the fourth conversion block is connected to and entirely overlaps with the front end surface of the second metal block;

the fifth conversion block is symmetrical with the third conversion block in the front-back direction, and a front end surface of the fifth conversion block is connected to and entirely overlaps with the rear end surface of the first metal block;

the sixth conversion block is symmetrical with the fourth conversion block in the front-back direction, a front end surface of the sixth conversion block is connected to and entirely overlaps with the rear end surface of the second metal block, the front end surface of the third conversion block, the front end surface of the fourth conversion block, a rear end surface of the fifth conversion block and a rear end surface of the sixth conversion block are used as the fourth output terminals of the first-level H-type E-plane waveguide power divider respectively, the front end surface of the first rectangular block is connected and attached to the rear end surface of the third metal block, a length of the first rectangular block in the left-right direction is 0.6λ, a distance from a left end of the front end surface of the first rectangular block to a left end of the rear end surface of the third metal block is equal to a distance from a right end of the front end surface of the first rectangular block to a right end of the rear end surface of the third metal block, and the rear end surface of the first rectangular block is used as the input terminal of the first-level H-type E-plane waveguide power divider. In this structure, the first-level H-type power dividers in the feed layer perform input and output in the same direction, so that the structure is compact, ultra-wideband and high-efficiency feeding of the plate antenna is realized, and miniaturization is facilitated.

The E-plane rectangular waveguide-single ridge waveguide transducer comprises a first rectangular metal block, wherein a rectangular port and a fourth rectangular cavity are formed in the first rectangular metal block, a rear end surface of the rectangular port is used as an input terminal of the E-plane rectangular waveguide-single ridge waveguide transducer, an upper end surface of the rectangular port is spaced apart from an upper end surface of the first rectangular metal block by a certain distance, a rear end surface of the rectangular port is located on the same plane as a rear end surface of the first rectangular metal block, an upper end surface of the fourth rectangular cavity is located on the same plane as the upper end surface of the first rectangular metal block, a left end surface of the fourth rectangular cavity is located on the same plane as a left end surface of the rectangular port, a rear end surface of the fourth rectangular cavity is connected and attached to a front end surface of the rectangular port, a lower end surface of the fourth rectangular cavity is located on the same plane as a lower end surface of the rectangular port, a right end surface of the rectangular port is spaced apart from a right end surface of the fourth rectangular cavity by a certain distance, the right end surface of the fourth rectangular cavity is spaced apart from a right end surface of the first rectangular metal block by a certain distance, a distance from the left end surface of the fourth rectangular cavity to the left end surface of the first rectangular metal block is equal to a distance from the right end surface of the fourth rectangular cavity to the right end surface of the first rectangular metal block, the lower end surface of the fourth rectangular cavity is spaced apart from the lower end surface of the first rectangular metal block by a certain distance, a single ridge step, an H-plane step and an E-plane step are arranged in the fourth rectangular cavity and are all rectangular blocks, a front end surface of the single ridge step, a front end surface of the H-plane step and a front end surface of the E-plane step are connected and attached to the front end surface of the fourth rectangular cavity, a left end surface of the H-plane step is connected and attached to the left end surface of the fourth rectangular cavity, a lower end surface of the H-plane step is connected and attached to the lower end surface of the fourth rectangular cavity, a right end surface of the H-plane step is connected and attached to a left end surface of the single ridge step, a lower end surface of the single ridge step is connected and attached to the lower end surface of the fourth rectangular cavity, an upper end surface of the single ridge step is located on the same plane as the upper end surface of the fourth rectangular cavity, a right end surface of the single ridge step is connected and attached to a left end surface of the E-plane step, a right end surface of the E-plane step is connected and attached to the right end surface of the fourth rectangular cavity, and a lower end surface of the E-plane step is connected and attached to the lower end surface of the fourth rectangular cavity.

A length of the H-plane step in the front-back direction is half of a length of the fourth rectangular cavity in the front-back direction, a length of the H-plane step in the left-right direction is one third of a length of the fourth rectangular cavity in the left-right direction, a length of the H-plane step in the vertical direction is two fifths of a length of the fourth rectangular cavity in the vertical direction, a length of the single ridge step in the front-back direction is half of a length of the fourth rectangular cavity in the front-back direction, a length of the single ridge step in the left-right direction is one third of a length of the fourth rectangular cavity in the left-right direction, a length of the single ridge step in the vertical direction is equal to a length of the fourth rectangular cavity in the vertical direction, a length of the E-plane step in the front-back direction is equal to a length of the fourth rectangular cavity in the front-back direction, a length of the E-plane step in the left-right direction is one third of a length of the fourth rectangular cavity in the left-right direction, a length of the E-plane step in the vertical direction is a quarter of a length of the fourth rectangular cavity in the vertical direction.

The upper end surface of the fourth rectangular cavity serves as the output terminal of the E-plane rectangular waveguide-single ridge waveguide transducer.

In this structure, the single ridge step, the H-plane step and the E-plane step are arranged in the E-plane rectangular waveguide-single ridge waveguide transducer to realize impedance matching and to reduce the return loss caused by structural discontinuities, so that the plate array antenna has a good wideband transmission property, uniform feeding to the radiation units in the radiation layer is fulfilled, the dominant-mode bandwidth can be expanded, and ultra-wideband and high-efficiency feeding of the array antenna is realized.

Compared with the prior art, the invention has the following advantages: each radiation unit in the radiation layer is constituted by two first radiation assemblies and two second radiation assemblies, wherein the two first radiation assemblies are parallelly arranged left and right and are spaced apart from each other, the first radiation assembly on the left will overlap with the first radiation assembly on the right after being moved rightwards by 0.9λ, the two second radiation assemblies are also arranged left and right and are spaced apart from each other, the second radiation assembly on the left will overlap with the second radiation assembly on the right after being moved rightwards by 0.9λ, the two second radiation assemblies are located behind the two first radiation assemblies, a center distance between the second radiation assembly on the left and the first radiation assembly on the left is 0.9λ, and a center distance between the second radiation assembly on the right and the first radiation assembly on the right is 0.9λ; each first radiation assembly comprises a first rectangular bar, a first rectangular cavity, a second rectangular cavity and a third rectangular cavity, wherein the first rectangular cavity, the second rectangular cavity and the third rectangular cavity are sequentially arranged from top to bottom, there exists an azimuth deviation between the three rectangular cavities, a center of the first rectangular bar, a center of the first rectangular cavity, a center of the second rectangular cavity and a center of the third rectangular cavity are located on the same center line, the first radiation assembly on the left will overlap with the second radiation assembly on the left after being moved downwards by 0.9λ and then being rotated clockwise by 180° around the center line, and the first radiation assembly on the right will overlap with the second radiation assembly on the right after being moved downwards by 0.9λ and then being rotated clockwise by 180° around the center line.

The first rectangular cavity, the second rectangular cavity and the third rectangular cavity in the first radiation assembly are stacked in presence of an azimuth deviation to form a three-layer coupled structure so as to optimize a multi-level radiation structure of traditional plate antennas into a one-level radiation structure, so that the profile height of the plate antennas is greatly decreased, and higher assembly precision can be realized easily.

The low-profile and miniaturized design restrains the property of cross polarization of the traditional plate antennas, obviously improves the gain and aperture efficiency of the plate antennas; in addition, the first rectangular bar located in the first rectangular cavity can better restrain cross polarization and reduce the sidelobe; therefore, the low-sidelobe plate array antenna of the invention has a low sidelobe, is simple in structure, low in cost and suitable for mass production, and has a wide frequency bandwidth and high efficiency.

DETAILED DESCRIPTION OF THE INVENTION

The invention will be further expounded below in conjunction with the accompanying drawings and embodiments.

Figure 1:
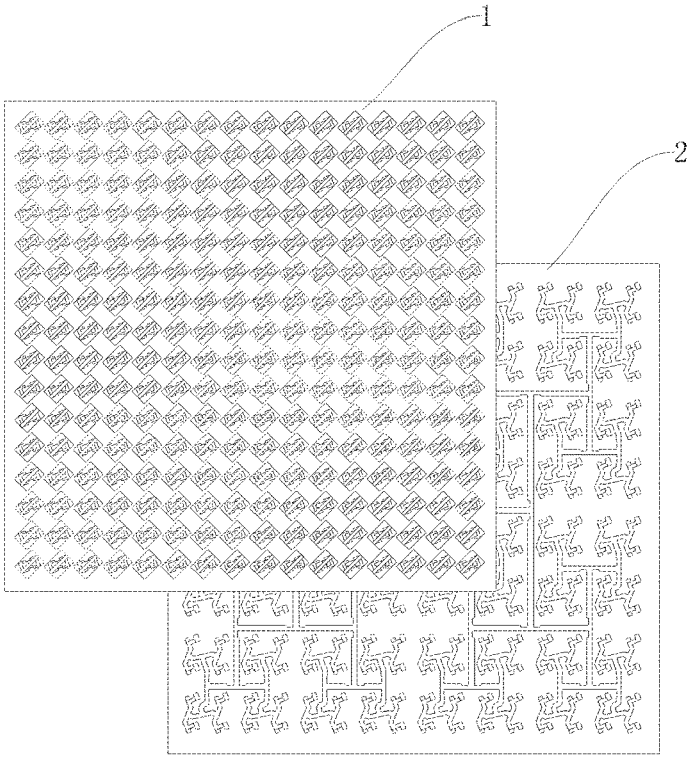
FIG. 1 is a first exploded view of a low-sidelobe plate array antenna of the invention.
Figure 2:
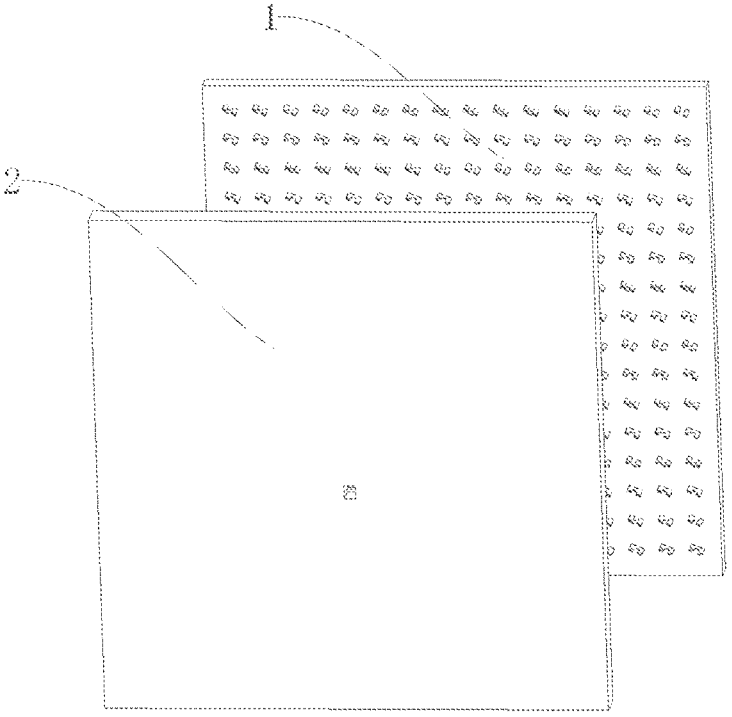
FIG. 2 is a second exploded view of the low-sidelobe plate array antenna of the invention.
Figure 3:
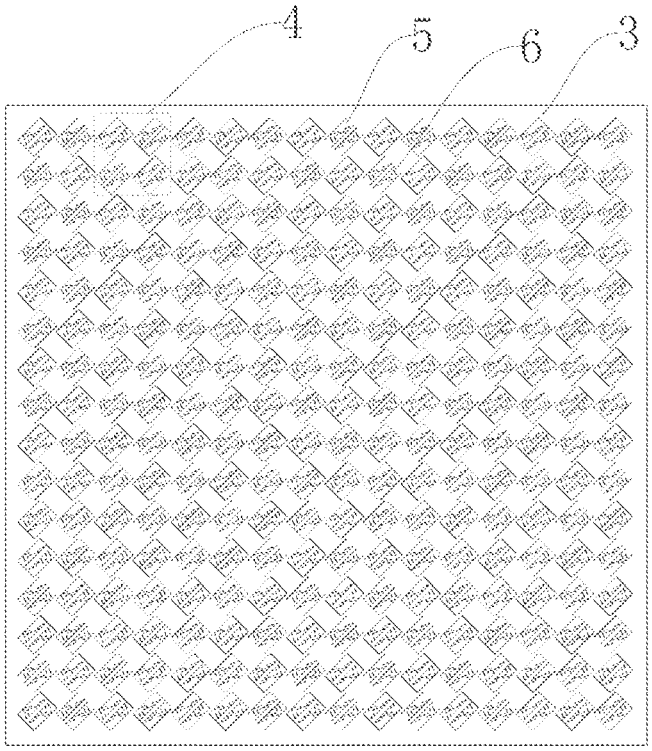
FIG. 3 is a top view of a radiation layer of the low-sidelobe plate array antenna of the invention.
Figure 4:
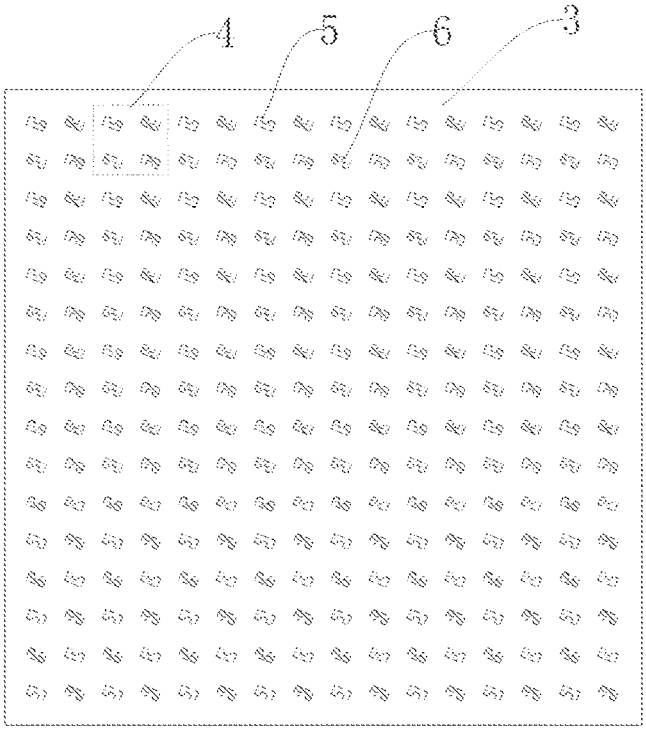
FIG. 4 is a bottom view of the radiation layer of the low-sidelobe plate array antenna of the invention.
Figure 5:
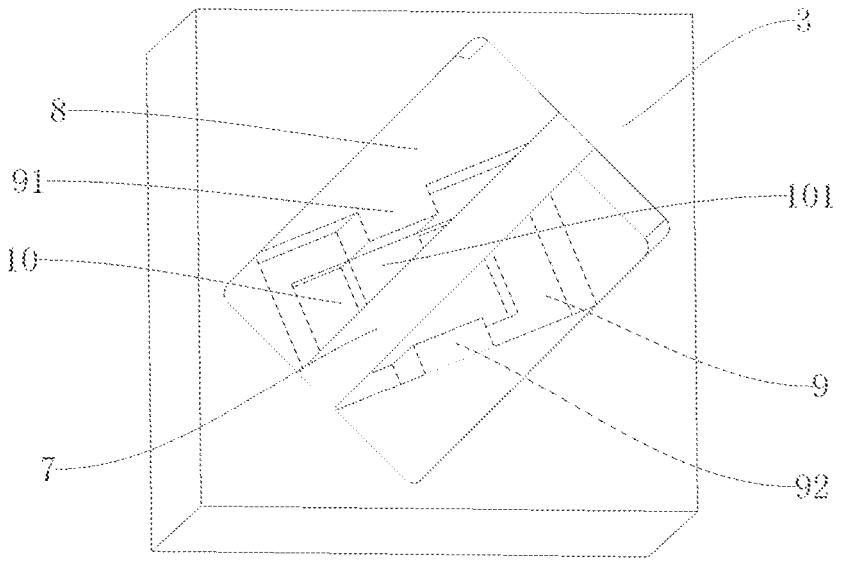
FIG. 5 is a perspective view of a first radiation assembly of the radiation layer of the low-sidelobe plate array antenna of the invention.

Embodiment: as shown in FIG. 1 and FIG. 2, a low-sidelobe plate array antenna comprises a radiation layer 1 and a feed layer 2, wherein the radiation layer 1 is superimposed on the feed layer 2, the feed layer 2 is used to output $4*n^2$ TE10 mode signals, the radiation layer 1 has $4*n^2$ input terminals and $4*n^2$ output terminals, the $4*n^2$ TE10 mode signals output by the feed layer 2 are accessed to the $4*n^2$ input terminals of the radiation layer 1 in a one-to-one correspondence, the $4*n^2$ output terminals of the radiation layer 1 are used to radiate the $4*n^2$ TE10 mode signals output by the feed layer 2 to a free space in a one-to-one correspondence, $n=2^{(k-1)}$, and k is an integer greater than or equal to 3; as shown in FIG. 3-FIG. 5, the radiation layer 1 comprises a first plate 3 and a radiation array disposed on the first plate 3, wherein the first plate 3 is a rectangular plate, the radiation array is formed by $n^2$ radiation units 4 which are distributed in $2^{(k-1)}$ rows and $2^{(k-1)}$ columns, a center distance between every two adjacent radiation unit 4 in each row is 1.8λ, a center distance between every two adjacent radiation units 4 in each column is 1.8λ, and λ=c/f, wherein c is a wave velocity, c=3*10^8 m/s, and f is a center operating frequency of the low-sidelobe plate array antenna; each radiation unit 4 comprises two first radiation assemblies 5 and two second radiation assemblies 6, wherein the two first radiation assemblies 5 are parallelly arranged left and right and are spaced apart from each other, the first radiation assembly 5 on the left will overlap with the first radiation assembly 5 on the right after being moved rightwards by 0.9λ, the two second radiation assemblies 6 are also arranged left and right and are spaced apart from each other, the second radiation assembly 6 on the left will overlap with the second radiation assembly 6 on the right after being moved rightwards by 0.9λ, the two second radiation assemblies 6 are located behind the two first radiation assemblies 5, a center distance between the second radiation assembly 6 on the left and the first radiation assembly 5 on the left is 0.9λ, and a center distance between the second radiation assembly 6 on the right and the first radiation assembly 5 on the right is 0.9λ.

Each first radiation assembly 5 comprises a first rectangular bar 7, a first rectangular cavity 8, a second rectangular cavity 9 and a third rectangular cavity 10, wherein the first rectangular cavity 8, the second rectangular cavity 9 and the third rectangular cavity 10 are sequentially arranged from top to bottom, a center of the first rectangular bar 7, a center of the first rectangular cavity 8, a center of the second rectangular cavity 9 and a center of the third rectangular cavity 10 are located on the same line which is perpendicular to the first plate 3 and is referred to as a center line, the first rectangular bar 7 is located in the first rectangular cavity 8, an upper end surface of the first rectangular bar 7 and an upper end surface of the first rectangular cavity 8 are located on the same plane as an upper end surface of the first plate 3, a front end surface of the first rectangular bar 7 and a front end surface of the first rectangular cavity 8 are formed and connected integrally and are attached together, a rear end surface of the first rectangular bar 7 and a rear end surface of the first rectangular cavity 8 are formed and connected integrally and are attached together; if the first rectangular cavity 8 is rotated anticlockwise by 45° around the center line, a plane where the front end surface of the first rectangular cavity 8 is located will be parallel to a plane where the front end surface of the first plate 3 is located, and a plane where a front end surface of the second rectangular cavity 9 is located will be parallel to a plane where a front end surface of the third rectangular cavity 10 is located; if the second rectangular cavity 9 is rotated anticlockwise by 67.5° around the center line, a plane where the front end surface of the second rectangular cavity 9 is located will be parallel to a plane where the front end surface of the first plate 3 is located, an upper end surface of the second rectangular cavity 9 will be located on the same plane as a lower end surface of the first rectangular cavity 8, an upper end surface of the third rectangular cavity 10 will be located on the same plane as a lower end surface of the second rectangular cavity 9, a lower end surface of the third rectangular cavity 10 will be located on the same plane as a lower end surface of the first plate 3, a distance from a left end surface of the first rectangular bar 7 to a left end surface of the first rectangular cavity 8 is equal to a distance from a right end surface of the first rectangular bar 7 to a right end surface of the first rectangular cavity 8, a distance from the front end surface to the rear end surface of the first rectangular cavity 8 is 0.8λ, a distance from the left end surface to the right end surface of the first rectangular cavity 8 is 0.6λ, a distance from the upper end surface to the lower end surface of the first rectangular cavity 8 is 0.3λ, a distance from the left end surface to the right end surface of the first rectangular bar 7 is 0.1λ, and a distance from the upper end surface to the lower end surface of the first rectangular bar 7 is 0.1λ; a distance from the front end surface to the rear end surface of the second rectangular cavity 9 is 0.6λ, a distance from the left end surface to the right end surface of the second rectangular cavity 9 is 0.4λ, and a distance from the upper end surface to the lower end surface of the second rectangular cavity 9 is 0.3λ.

A first rectangular matching plate 91 and a second rectangular matching plate 92 are arranged in the second rectangular cavity 9, a left side wall of the first rectangular matching plate and a left side wall of the second rectangular cavity 9 are attached together and are formed and connected integrally, a distance from a front end surface of the first rectangular matching plate to a front end surface of the second rectangular cavity 9 is equal to a distance from a rear end surface of the first rectangular matching plate to a rear end surface of the second rectangular cavity 9, a distance from a left end surface to a right end surface of the first rectangular matching plate is 0.1λ, a distance from a front end surface to a rear end surface of the first rectangular matching plate is 0.2λ.

An upper end surface of the first rectangular matching plate 91 is located on the same plane as the upper end surface of the second rectangular cavity 9, a lower end surface of the first rectangular matching plate 91 is located on the same plane as the lower end surface of the second rectangular cavity 9, and the second rectangular matching plate 92 and the first rectangular matching plate 91 are symmetrical left and right with respect to a left-right bisecting plane of the second rectangular cavity 9.

A distance from the front end surface to the rear end surface of the third rectangular cavity 10 is 0.4λ, a distance from the left end surface to the right end surface of the third rectangular cavity 10 is 0.2λ, a distance from the upper end surface to the lower end surface of the third rectangular cavity 10 is 0.1λ, a third rectangular matching plate 101 is arranged in the third rectangular cavity 10, a left side wall of the third rectangular matching plate 101 and a left side wall of the third rectangular cavity 10 are attached together and are formed and connected integrally, a distance from a front end surface of the third rectangular matching plate 101 to the front end surface of the third rectangular cavity 10 is equal to a distance from a rear end surface of the third rectangular matching plate to the rear end surface of the third rectangular cavity 10, an upper end surface of the third rectangular matching plate 101 is located on the same plane as the upper end surface of the third rectangular cavity 10, a lower end surface of the third rectangular matching plate is located on the same plane as the lower end surface of the third rectangular cavity 10, a distance from a left end surface to a right end surface of the third rectangular matching plate is 0.1λ, a distance from a front end surface to a rear end surface of the third rectangular matching plate 101 is 0.2λ, the upper end surface of the first rectangular cavity 8 is used as an output terminal of the first radiation assembly 5, and the lower end surface of the third rectangular cavity 10 is used as an input terminal of the first radiation assembly 5.

If the first radiation assembly 5 on the left is moved downwards by 0.9λ and is then rotated clockwise by 180° around the center line, the first radiation assembly 5 on the left will overlap with the second radiation assembly 6 on the left; if the first radiation assembly 5 on the right is moved downwards by 0.9λ and is then rotated clockwise by 180° around the center line, the first radiation assembly 5 on the right will overlap with the second radiation assembly 6 on the right.

The input terminals of the two first radiation assemblies 5 and input terminals of the two second radiation assemblies 6 are used as four input terminals of the radiation unit 4; the four input terminals of each radiation unit 4 are used as four input terminals of the radiation layer 1, and the radiation layer 1 has $4*n^2$ input terminals; the output terminals of the two first radiation assemblies 5 and output terminals of the two second radiation assemblies 6 are used as four output terminals of the radiation unit 4, the four output terminals of each radiation unit 4 are used as four output terminals of the radiation layer 1, and the radiation layer 1 has $4*n^2$ output terminals.

Figure 6:
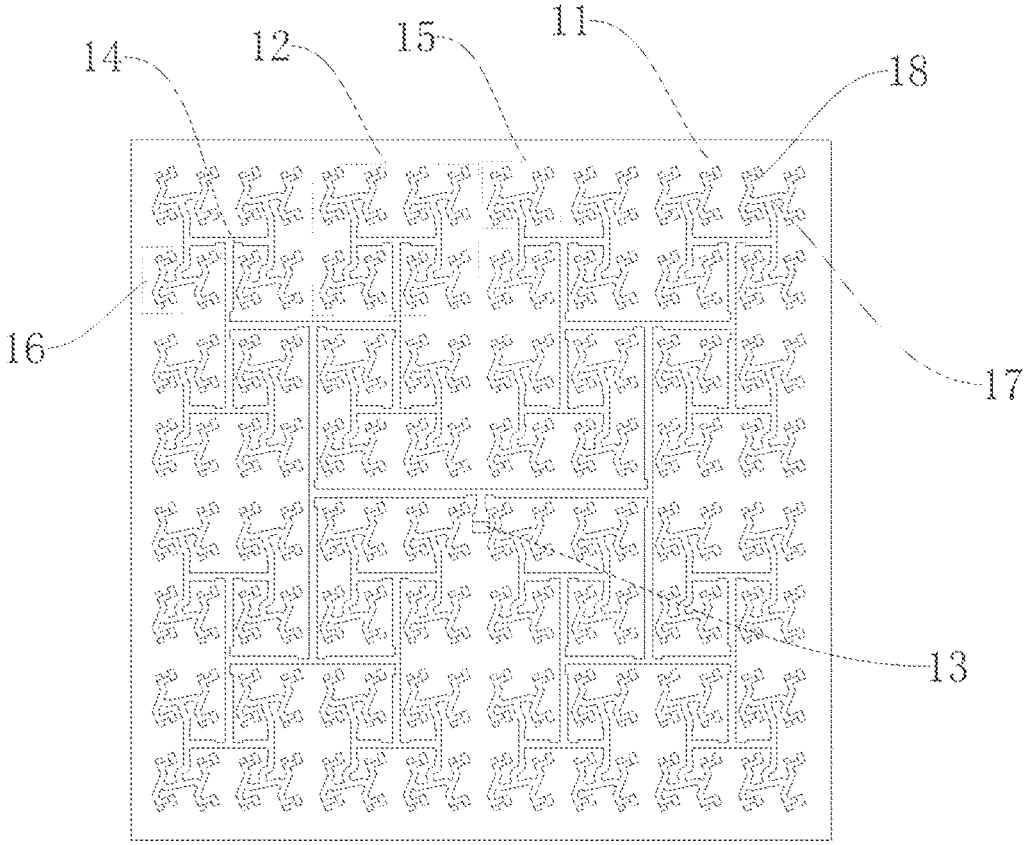
FIG. 6 is a top view of a feed layer of the low-sidelobe plate array antenna of the invention.
Figure 7:
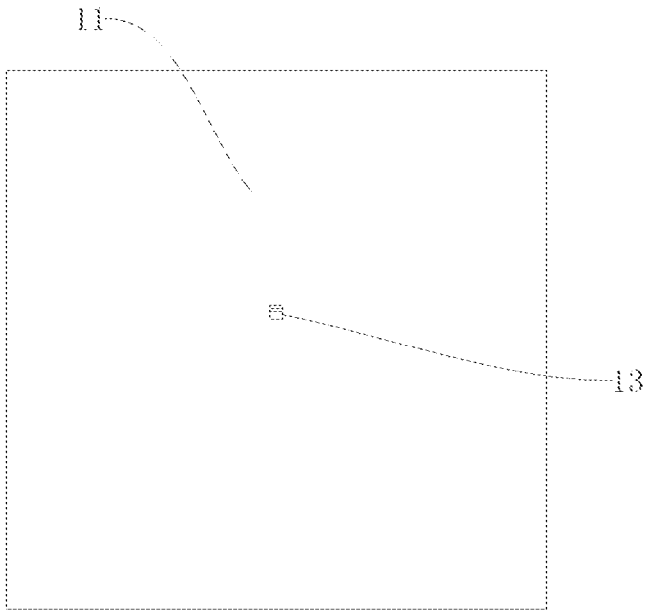
FIG. 7 is a bottom view of the feed layer of the low-sidelobe plate array antenna of the invention.

In this embodiment, as shown in FIG. 6 and FIG. 7, the feed layer 2 comprises a second plate 11, $$\left(\frac{n}{2^1}\right)^2$$

first-level H-type E-plane waveguide power division network units 12 and a standard waveguide input port 13, wherein the $$\left(\frac{n}{2^1}\right)^2$$

first-level H-type E-plane waveguide power division network units 12 and the standard waveguide input port 13 are disposed on the second plate 11, and the second plate 11 is a rectangular plate; each first-level H-type E-plane waveguide power division network unit 12 comprises a first-level H-type E-plane waveguide power division network and a second-level H-type E-plane waveguide power divider 14, wherein the first-level H-type E-plane waveguide power division network comprises two first H-type E-plane waveguide power division networks 15 and two second H-type E-plane waveguide power division networks 16, the two first H-type E-plane waveguide power division networks 15 are parallelly arranged left and right and are spaced apart from each other, the first H-type E-plane waveguide power division network 15 on the left will overlap with the first H-type E-plane waveguide power division network 15 on the right after being moved rightwards by 1.8λ, the two second H-type E-plane waveguide power division networks 16 are arranged left and right and are spaced apart from each other, the second H-type E-plane waveguide power division network 16 on the left will overlap with the second H-type E-plane waveguide power division network 16 on the right after being moved rightwards by 1.8λ, the two second H-type E-plane waveguide power division networks 16 are located behind the two first H-type E-plane waveguide power division networks 15, a center distance between the second H-type E-plane waveguide power division network 16 on the left and the first H-type E-plane waveguide power division network 15 on the left is 1.8λ, the second H-type E-plane waveguide power division network 16 on the left and the first H-type E-plane waveguide power division network 15 on the left are symmetrical front and back, a center distance between the second H-type E-plane waveguide power division network 16 on the right and the first H-type E-plane waveguide power division network 15 on the right is 1.8λ, and the second H-type E-plane waveguide power division network 16 on the right and the first H-type E-plane waveguide power division network 15 on the right are symmetrical front and back.

Each first H-type E-plane waveguide power division network 15 comprises a first-level H-type E-plane waveguide power divider 17 and four E-plane rectangular waveguide-single ridge waveguide transducers 18, wherein the first-level H-type E-plane waveguide power divider 17 has an input terminal and four output terminals, divides a signal input via the input terminal thereof into four signals with the same power and phase, and outputs the four signals via the four output terminals thereof respectively, each E-plane rectangular waveguide-single ridge waveguide transducer 18 has an input terminal and an output terminal and is used to convert a rectangular waveguide accessed to the input terminal thereof into a single ridge waveguide and output the single ridge waveguide via the output terminal thereof, the input terminals of the four E-plane rectangular waveguide-single ridge waveguide transducers 18 are connected to the four output terminals of the first-level H-type E-plane waveguide power divider 17 in a one-to-one correspondence, the input terminal of the first-level H-type E-plane waveguide power divider 17 is used as an input terminal of the first H-type E-plane waveguide power division network 15, the output terminal of each E-plane rectangular waveguide-single ridge waveguide transducer 18 is used as an output terminal of the first H-type E-plane waveguide power division network 15, and the first H-type E-plane waveguide power division network 15 has one input terminal and four output terminals.

The input terminals of the two first H-type E-plane waveguide power division networks 15 and input terminals of the two second H-type E-plane waveguide power division networks 16 are used as input terminals of the first-level H-type E-plane waveguide power division network, four output terminals of each of the two first H-type E-plane waveguide power division networks 15 and four output terminals of each of the two second H-type E-plane waveguide power division networks 16 are used as output terminals of the first-level H-type E-plane waveguide power division network, and the first-level H-type E-plane waveguide power division network has four input terminals and sixteen output terminals; the second-level H-type E-plane waveguide power divider 14 has an input terminal and four output terminals and is used to divide a signal input via the input terminal thereof into four signals with the same power and phase and output the four signals via the four output terminals thereof respectively, the input terminal of the second-level H-type E-plane waveguide power divider 14 is used as an input terminal of the first-level H-type E-plane waveguide power division network unit 12, the four output terminals of the second-level H-type E-plane waveguide power divider 14 are connected to the four input terminals of the first-level H-type E-plane waveguide power division network in a one-to-one correspondence, the sixteen output terminals of the first-level H-type E-plane waveguide power division network are used as sixteen output terminals of the first-level H-type E-plane waveguide power division network unit 12, and the $$\left(\frac{n}{2^1}\right)^2$$

first-level H-type E-plane waveguide power division network units 12 have $$16*\left(\frac{n}{2^1}\right)^2$$

output terminals, and the $$16*\left(\frac{n}{2^1}\right)^2$$

output terminals of the $$\left(\frac{n}{2^1}\right)^2$$

first-level H-type E-plane waveguide power division network units 12 are used as $$16*\left(\frac{n}{2^1}\right)^2$$

output terminals of the feed layer 2 and are connected to the $4*n^2$ input terminals of the radiation layer 1 in a one-to-one correspondence; the $$\left(\frac{n}{2^1}\right)^2$$

first-level H-type E-plane waveguide power division network units 12 are regularly distributed in $$\frac{n}{2^1}$$

rows and $$\frac{n}{2^1}$$

columns at intervals to form a first-level feed network array.

A center distance between every two adjacent first-level H-type E-plane waveguide power division network units 12 in each row is 3.6λ, and a center distance between every two adjacent first-level H-type E-plane waveguide power division network units 12 in each column is 3.6λ.

From the first row and the first column of the first-level feed network array, the four first-level H-type E-plane waveguide power division network units 12 in every two rows and every two columns form a first-level network unit group, and the first-level feed network array totally includes $$\left(\frac{n}{2^2}\right)^2$$

first-level network unit groups.

A third-level H-type E-plane waveguide power divider is disposed in each first-level network unit group, has an input terminal and four output terminals, and is used to divide a signal input via the input terminal thereof into four signals with the same power and phase via the four output terminals thereof respectively, the four output terminals of the third-level H-type E-plane waveguide power divider are connected to the input terminals of the four first-level H-type E-plane waveguide power division network units 12 in the first-level network unit group in a one-to-one correspondence, the first-level network unit group and the third-level H-type E-plane waveguide power divider connected thereto form a second-level H-type E-plane waveguide power division network unit, the input terminal of the third-level H-type E-plane waveguide power divider is used as an input terminal of the second-level H-type E-plane waveguide power division network unit, $$\left(\frac{n}{2^2}\right)^2$$

second-level H-type E-plane waveguide power division network units which are distributed in $$\frac{n}{2^2}$$

rows and $$\frac{n}{2^2}$$

columns are obtained in total, and the $$\left(\frac{n}{2^2}\right)^2$$

second-level H-type E-plane waveguide power division network units form a second-level feed network array;

from the first row and the first column of the second-level feed network array, the four second-level H-type E-plane waveguide power division network units in every two rows and every two columns form a second-level network unit group, the second-level feed network array totally includes $$\left(\frac{n}{2^3}\right)^2$$

second-level network unit groups, the input terminal of the third-level H-type H-plane waveguide power divider of each second-level H-type E-plane waveguide power division network unit in the second-level network unit group is used as an input terminal of the second-level network unit group, and the second-level network unit group has four input terminals; a fourth-level H-type E-plane waveguide power divider is disposed in each second-level network unit group, has an input terminal and four output terminals, and is used to divide a signal input via the input terminal thereof into four output signals with the same power and phase and output the four signals via the four output terminals thereof respectively, the four output terminals of the fourth-level H-plane E-plane waveguide power divider are connected to the four input terminals of the second-level network unit group in a one-to-one correspondence, the second-level network unit group and the fourth-level H-type E-plane waveguide power divider connected thereto form a third-level H-type E-plane waveguide power division network unit, the input terminal of the fourth-level H-type E-plane waveguide power divider is used as an input terminal of the third-level H-type E-plane waveguide power division network unit, $$\left(\frac{n}{2^3}\right)^2$$

third-level H-type E-plane waveguide power division network units which are distributed in $$\frac{n}{2^3}$$

rows and $$\frac{n}{2^3}$$

columns are obtained in total, and the $$\left(\frac{n}{2^3}\right)^2$$

third-level H-type E-plane waveguide power division network units form a third-level feed network array.

By this analogy, a $(k-2)^{th}$-level feed network array is formed by $$\left(\frac{n}{2^{k-2}}\right)^2$$

$(k-2)^{th}$-level H-type E-plane waveguide power division network units, a $(k-1)^{th}$-level H-type E-plane waveguide power divider is arranged among the four $(k-2)^{th}$-level H-type E-plane waveguide power division network units in the $(k-2)^{th}$-level feed network array, has an input terminal and four output terminals, and is used to divide a signal input via the input terminal thereof into four signals with the same power and phase and output the four signals via the output terminals thereof respectively, the four output terminals of the $(k-1)^{th}$-level H-type E-plane waveguide power divider are connected to the input terminals of the four $(k-2)^{th}$-level H-type E-plane waveguide power division network units in a one-to-one correspondence, the input terminal of the $(k-1)^{th}$-level H-type E-plane waveguide power divider is connected to the standard waveguide input port 13 which is used as an input terminal of the feed layer 2, and the input terminal of the feed layer 2 is connected to an external signal interface.

Figure 8:
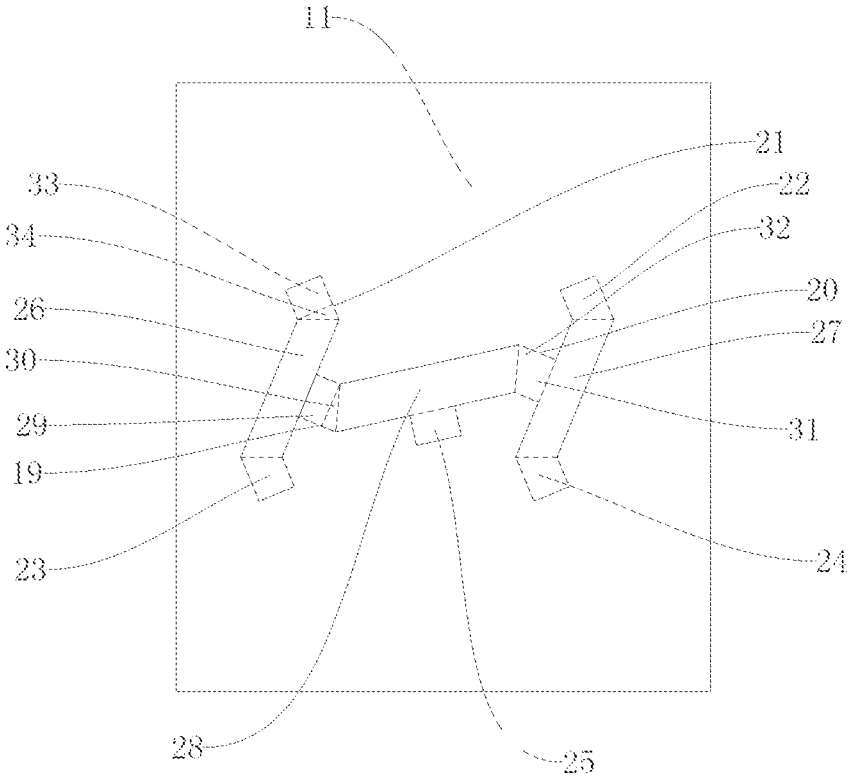
FIG. 8 is an exploded view of a first-level H-type E-plane waveguide power divider of the feed layer of the low-sidelobe plate array antenna of the invention.

As show in FIG. 8, the first-level H-type E-plane waveguide power divider 17 comprises a first conversion block 19, a second conversion block 20, a third conversion block 21, a fourth conversion block 22, a fifth conversion block 23, a sixth conversion block 24, a first rectangular block 25, a first metal block 26, a second metal block 27 and a third metal block 28, wherein an upper end surface of the first conversion block 19, an upper end surface of the second conversion block 20, an upper end surface of the third conversion block 21, an upper end surface of the fourth conversion block 22, an upper end surface of the fifth conversion block 23, an upper end surface of the sixth conversion block 24, an upper end surface of the first rectangular block 25, an upper end surface of the first metal block 26, an upper end surface of the second metal block 27 and an upper end surface of the third metal block 28 are located on the same plane as an upper end surface of the second plate 11; a lower end surface of the first conversion block 19, a lower end surface of the second conversion block 20, a lower end surface of the third conversion block 21, a lower end surface of the fourth conversion block 22, a lower end surface of the fifth conversion block 23, a lower end surface of the sixth conversion block 24, a lower end surface of the first rectangular block 25, a lower end surface of the first metal block 26, a lower end surface of the second metal block 27 and a lower end surface of the third metal block 28 are located on the same plane as a lower end surface of the second plate 11.

The first metal block 26 is a parallelogram block, a front end surface of the first metal block 26 is parallel to a front end surface of the second plate 11, a left end surface of the first metal block 26 will be parallel to a left end surface of the second plate 11 after the first metal block 26 is rotated anticlockwise by 22.5° around a center thereof, a length of the front end surface of the first metal block 26 in the left-right direction is 0.1λ, a length of the front end surface of the first metal block 26 in the front-back direction is 0.5λ, a length of the first metal block 26 in the vertical direction is 0.8λ, and the first metal block 26 will overlap with the second metal block 27 after being moved rightwards by 0.9λ.

The third metal block 28 is located between the first metal block 26 and the second metal block 27 and is a parallelogram block, a front end surface of the third metal block 28 will be parallel to the front end surface of the second plate 11 after the third metal block is rotated clockwise by 12.5° around a center thereof, and a length of the front end surface of the third metal block 28 in the left-right direction is 0.6λ.

The first conversion block 19 comprises a second rectangular block 29 and a first right triangle block 30, a left end surface of the second rectangular block 29 serves as a left end surface of the first conversion block 19, the left end surface of the first conversion block 19 is connected and attached to a right end surface of the first metal block 26, a length of a front end surface of the second rectangular block 29 in the left-right direction is 0.1λ, a length of the left end surface of the second rectangular block 29 in the front-back direction is 0.2λ, a distance from the front end surface of the second rectangular block 29 to a front end surface of the first metal block 26 will be equal to a distance from a rear end surface of the second rectangular block 29 to a rear end surface of the first metal block 26 after the second rectangular block 29 is rotated anticlockwise by 22.5° around a center thereof, an end surface, where a first right-angle side of the first right triangle block 30 is located, is connected and attached to a right end surface of the second rectangular block 29, a length of the end surface, where the first right-angle side of the first right triangle block 30 is located, in the front-back direction is equal to a length of the left end surface of the second rectangular block 29 in the front-back direction, an end surface, where a second right-angle side of the first right triangle block 30 is located, is located on the same plane as the rear end surface of the second rectangular block 29, an included angle between the end surface where the first right-angle side of the first right triangle block 30 is located and an end surface where a hypotenuse of the first right triangle block 30 is located is 22.5°, and the end surface, where the hypotenuse of the first right triangle block 30 is located, is connected to and entirely overlaps with a left end surface of the third metal block 28.

The second conversion block 20 comprises a third rectangular block 31 and a second right triangle block 32, wherein a right end surface of the third rectangular block 31 serves as a right end surface of the second conversion block 20, the right end surface of the second conversion block 20 is connected and attached to a left end surface of the second metal block 27, a length of a front end surface of the third rectangular block 31 in the left-right direction is 0.1λ, a length of the right end surface of the third rectangular block 31 in the front-back direction is 0.2λ, a distance from the front end surface of the third rectangular block 31 to a front end surface of the second metal block 27 is equal to a distance from a rear end surface of the third rectangular block 31 to a rear end surface of the second metal block 27 after the third rectangular block 31 is rotated anticlockwise by 22.5° around a center thereof, an end surface, where a first right-angle side of the second right triangle block 32 is located, is connected and attached to a left end surface of the third rectangular block 31, a length of the end surface, where the first right-angle side of the second right triangle block 32 is located, in the front-back direction is equal to a length of the left end surface of the third rectangular block 31 in the front-back direction, an end surface, where a second right-angle side of the second right triangle block 32 is located, is located on the same plane as the front end surface of the third rectangular block 31, an included angle between the end surface where the second right-angle side of the second right triangle block 32 is located and an end surface where a hypotenuse of the second right triangle block 32 is located is 22.5°, and the end surface, where the hypotenuse of the second right triangle block 32 is located, will be connected to and entirely overlap with a right end surface of the third metal block 28.

The third conversion block 21 comprises a fourth rectangular block 33 and a third right triangle block 34, wherein a front end surface of the fourth rectangular block 33 serves as a front end surface of the third conversion block 21, a length of the front end surface of the fourth rectangular block 33 in the left-right direction is 0.1λ, an end surface, where a first right-angle side of the third right triangle block 34 is located, entirely overlaps with a rear end surface of the fourth rectangular block 33, a length of the end surface, where the first right-angle side of the third right triangle block 34 is located, is equal to a length of the rear end surface of the fourth rectangular block 33 in the left-right direction, an end surface, where a second right-angle side of the third right triangle block 34 is located, is located on the same plane as a right end surface of the fourth rectangular block 33, an included angle between the end surface where the first right-angle side of the third right triangle block 34 is located and an end surface where a hypotenuse of the third right triangle block 34 is located is 22.5°, the end surface, where the hypotenuse of the third right triangle block 34 is located, will be connected to and entirely overlap with the front end surface of the first metal block 26, the third conversion block 21 will entirely overlap with the fourth conversion block 22 after being moved rightwards by 0.9λ, and the rear end surface of the fourth conversion block 22 is connected to and entirely overlaps with the front end surface of the second metal block 27.

The fifth conversion block 23 is symmetrical with the third conversion block 21 in the front-back direction, and a front end surface of the fifth conversion block 23 is connected to and entirely overlaps with the rear end surface of the first metal block 26.

The sixth conversion block 24 is symmetrical with the fourth conversion block 22 in the front-back direction, a front end surface of the sixth conversion block 24 is connected to and entirely overlaps with the rear end surface of the second metal block 27, the front end surface of the third conversion block 21, the front end surface of the fourth conversion block 22, a rear end surface of the fifth conversion block 23 and a rear end surface of the sixth conversion block 25 are used as the fourth output terminals of the first-level H-type E-plane waveguide power divider 17 respectively, the front end surface of the first rectangular block 25 is connected and attached to the rear end surface of the third metal block 28, a length of the first rectangular block 25 in the left-right direction is 0.6λ, a distance from a left end of the front end surface of the first rectangular block 25 to a left end of the rear end surface of the third metal block 28 is equal to a distance from a right end of the front end surface of the first rectangular block 25 to a right end of the rear end surface of the third metal block 28, and the rear end surface of the first rectangular block 25 is used as the input terminal of the first-level H-type E-plane waveguide power divider 17.

Figure 9:
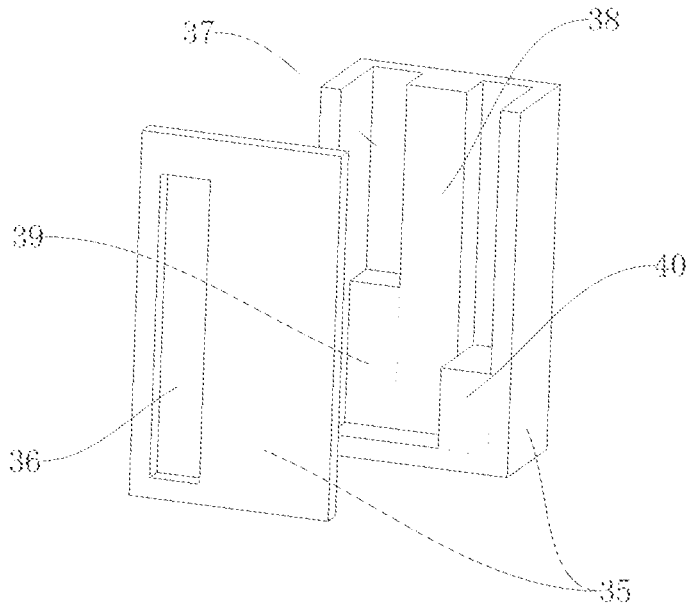
FIG. 9 is an exploded view of an E-plane rectangular waveguide-single ridge waveguide transducer of the feed layer of the low-sidelobe plate array antenna of the invention.

In this embodiment, as shown in FIG. 9, the E-plane rectangular waveguide-single ridge waveguide transducer 18 comprises a first rectangular metal block 35, wherein a rectangular port 36 and a fourth rectangular cavity 37 are formed in the first rectangular metal block 35, a rear end surface of the rectangular port 36 is used as an input terminal of the E-plane rectangular waveguide-single ridge waveguide transducer 18, an upper end surface of the rectangular port 36 is spaced apart from an upper end surface of the first rectangular metal block 35 by a certain distance, a rear end surface of the rectangular port 36 is located on the same plane as a rear end surface of the first rectangular metal block 35, an upper end surface of the fourth rectangular cavity 37 is located on the same plane as the upper end surface of the first rectangular metal block 35, a left end surface of the fourth rectangular cavity 37 is located on the same plane as a left end surface of the rectangular port 36, a rear end surface of the fourth rectangular cavity 37 is connected and attached to a front end surface of the rectangular port 36, a lower end surface of the fourth rectangular cavity 37 is located on the same plane as a lower end surface of the rectangular port 36, a right end surface of the rectangular port 36 is spaced apart from a right end surface of the fourth rectangular cavity 37 by a certain distance, the right end surface of the fourth rectangular cavity 37 is spaced apart from a right end surface of the first rectangular metal block 35 by a certain distance, a distance from the left end surface of the fourth rectangular cavity 37 to the left end surface of the first rectangular metal block 35 is equal to a distance from the right end surface of the fourth rectangular cavity 37 to the right end surface of the first rectangular metal block 35, the lower end surface of the fourth rectangular cavity 37 is spaced apart from the lower end surface of the first rectangular metal block 35 by a certain distance.

A single ridge step 38, an H-plane step 39 and an E-plane step 40 are arranged in the fourth rectangular cavity 37 and are all rectangular blocks, a front end surface of the single ridge step 38, a front end surface of the H-plane step 39 and a front end surface of the E-plane step 40 are connected and attached to the front end surface of the fourth rectangular cavity 37, a left end surface of the H-plane step 39 is connected and attached to the left end surface of the fourth rectangular cavity 37, a lower end surface of the H-plane step 39 is connected and attached to the lower end surface of the fourth rectangular cavity 37, a right end surface of the H-plane step 39 is connected and attached to a left end surface of the single ridge step 38, a lower end surface of the single ridge step 38 is connected and attached to the lower end surface of the fourth rectangular cavity 37, an upper end surface of the single ridge step 38 is located on the same plane as the upper end surface of the fourth rectangular cavity 37, a right end surface of the single ridge step 38 is connected and attached to a left end surface of the E-plane step 40, a right end surface of the E-plane step 40 is connected and attached to the right end surface of the fourth rectangular cavity 37, and a lower end surface of the E-plane step 40 is connected and attached to the lower end surface of the fourth rectangular cavity 37.

A length of the H-plane step 39 in the front-back direction is half of a length of the fourth rectangular cavity 37 in the front-back direction, a length of the H-plane step 39 in the left-right direction is one third of a length of the fourth rectangular cavity 37 in the left-right direction, a length of the H-plane step 39 in the vertical direction is two fifths of a length of the fourth rectangular cavity 37 in the vertical direction, a length of the single ridge step 38 in the front-back direction is half of a length of the fourth rectangular cavity 37 in the front-back direction, a length of the single ridge step 38 in the left-right direction is one third of a length of the fourth rectangular cavity 37 in the left-right direction, a length of the single ridge step 38 in the vertical direction is equal to a length of the fourth rectangular cavity 37 in the vertical direction, a length of the E-plane step 40 in the front-back direction is equal to a length of the fourth rectangular cavity 37 in the front-back direction, a length of the E-plane step 40 in the left-right direction is one third of a length of the fourth rectangular cavity 37 in the left-right direction, a length of the E-plane step 40 in the vertical direction is a quarter of a length of the fourth rectangular cavity 37 in the vertical direction.

The upper end surface of the fourth rectangular cavity 37 serves as the output terminal of the E-plane rectangular waveguide-single ridge waveguide transducer 18.

Figure 10:
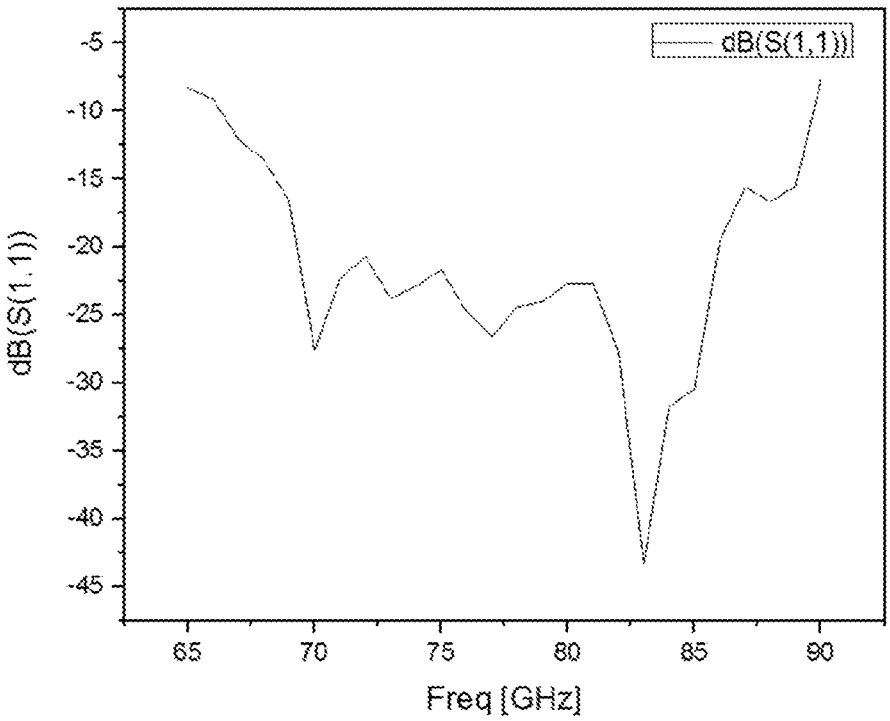
FIG. 10 is a simulated curve chart of the reflection coefficient of the low-sidelobe plate array antenna of the invention.
Figure 11:
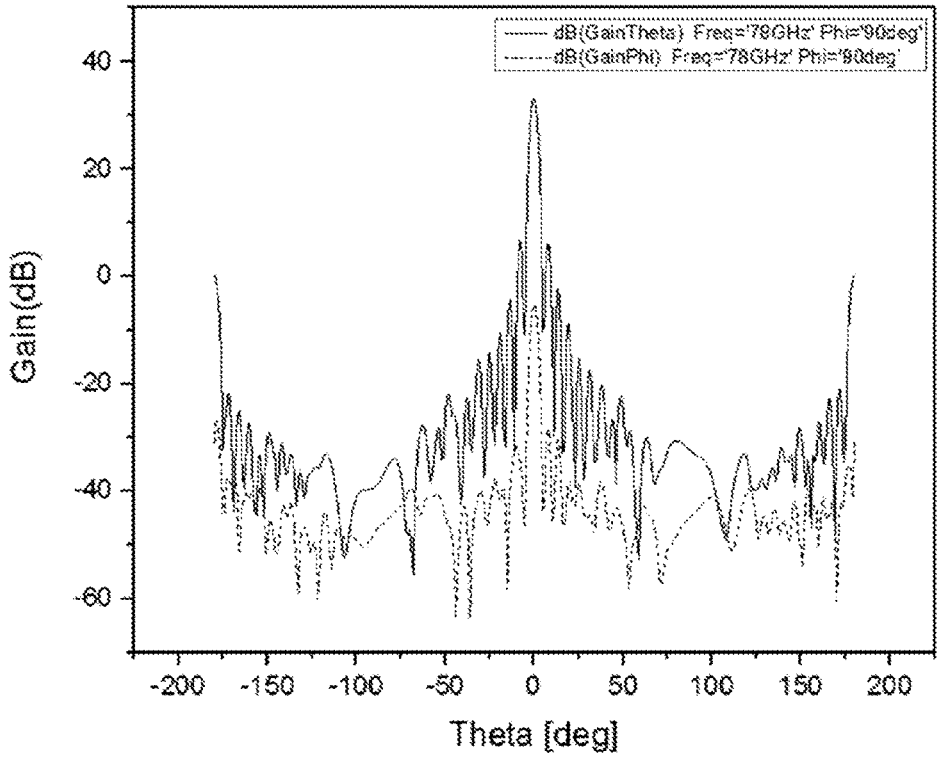
FIG. 11 is an H-plane directional diagram of the low-sidelobe plate array antenna of the invention.
Figure 12:
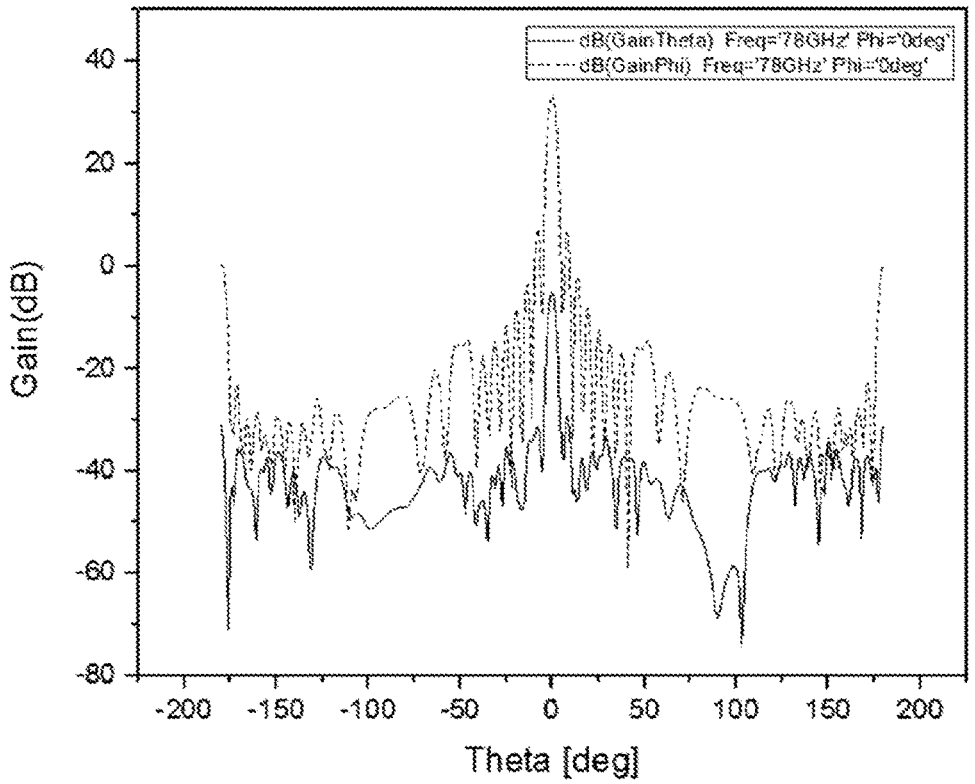
FIG. 12 is an E-plane directional diagram of the low-sidelobe plate array antenna of the invention.

The low-sidelobe plate array antenna of the invention is simulated. A simulated curve chart of the reflection coefficient S11 of the low-sidelobe plate array antenna of the invention is shown in FIG. 10. An H-plane directional diagram of the low-sidelobe plate array antenna of the invention is shown in FIG. 11. An E-plane directional diagram of the low-sidelobe plate array antenna of the invention is shown in FIG. 12. As shown in FIG. 10, within the frequency range of 70-85 GHz, the reflection coefficient of the low-sidelobe plate array antenna of the invention is superior to −20 dB, and the relative bandwidth under −10 dB is greater than 30%. As shown in FIG. 11, the H-plane peak gain of the low-sidelobe plate array antenna of the invention is greater than 33 dB. As shown in FIG. 12, the E-plane peak gain of the low-sidelobe plate array antenna of the invention is greater than 33 dB.

What is claimed is:

1. A low-sidelobe plate array antenna, comprising:

a radiation layer; and a feed layer, wherein the radiation layer is superimposed on the feed layer, the feed layer is used to output $4*n^2$ TE10 mode signals, the radiation layer has $4*n^2$ input terminals and $4*n^2$ output terminals, the $4*n^2$ TE10 mode signals output by the feed layer are accessed to the $4*n^2$ input terminals of the radiation layer in a one-to-one correspondence, the $4*n^2$ output terminals of the radiation layer are used to radiate the $4*n^2$ TE10 mode signals output by the feed layer to a free space in a one-to-one correspondence, $n=2^{(k-1)}$, and k is an integer greater than or equal to 3;

the radiation layer comprises a first plate and a radiation array disposed on the first plate, wherein the first plate is a rectangular plate, the radiation array is formed by $n^2$ radiation units which are distributed in $2^{(k-1)}$ rows and $2^{(k-1)}$ columns, a center distance between every two adjacent radiation unit in each row is 1.8λ, a center distance between every two adjacent radiation units in each column is 1.8λ, and λ=c/f, wherein c is a wave velocity, c=3*10^8 m/s, and f is a center operating frequency of the low-sidelobe plate array antenna; each radiation unit comprises two first radiation assemblies and two second radiation assemblies, wherein the two first radiation assemblies are parallelly arranged left and right and are spaced apart from each other, the first radiation assembly on the left will overlap with the first radiation assembly on the right after being moved rightwards by 0.9λ, the two second radiation assemblies are also arranged left and right and are spaced apart from each other, the second radiation assembly on the left will overlap with the second radiation assembly on the right after being moved rightwards by 0.9λ, the two second radiation assemblies are located behind the two first radiation assemblies, a center distance between the second radiation assembly on the left and the first radiation assembly on the left is 0.9λ, and a center distance between the second radiation assembly on the right and the first radiation assembly on the right is 0.9λ;

each first radiation assembly comprises a first rectangular bar, a first rectangular cavity, a second rectangular cavity and a third rectangular cavity, wherein the first rectangular cavity, the second rectangular cavity and the third rectangular cavity are sequentially arranged from top to bottom, a center of the first rectangular bar, a center of the first rectangular cavity, a center of the second rectangular cavity and a center of the third rectangular cavity are located on the same line which is perpendicular to the first plate and is referred to as a center line, the first rectangular bar is located in the first rectangular cavity, an upper end surface of the first rectangular bar and an upper end surface of the first rectangular cavity are located on the same plane as an upper end surface of the first plate, a front end surface of the first rectangular bar and a front end surface of the first rectangular cavity are formed and connected integrally and are attached together, a rear end surface of the first rectangular bar and a rear end surface of the first rectangular cavity are formed and connected integrally and are attached together; if the first rectangular cavity is rotated anticlockwise by 45° around the center line, a plane where the front end surface of the first rectangular cavity is located will be parallel to a plane where the front end surface of the first plate is located, and a plane where a front end surface of the second rectangular cavity is located will be parallel to a plane where a front end surface of the third rectangular cavity is located; if the second rectangular cavity is rotated anticlockwise by 67.5° around the center line, a plane where the front end surface of the second rectangular cavity is located will be parallel to a plane where the front end surface of the first plate is located, an upper end surface of the second rectangular cavity will be located on the same plane as a lower end surface of the first rectangular cavity, an upper end surface of the third rectangular cavity will be located on the same plane as a lower end surface of the second rectangular cavity, a lower end surface of the third rectangular cavity will be located on the same plane as a lower end surface of the first plate, a distance from a left end surface of the first rectangular bar to a left end surface of the first rectangular cavity is equal to a distance from a right end surface of the first rectangular bar to a right end surface of the first rectangular cavity, a distance from the front end surface to the rear end surface of the first rectangular cavity is 0.8λ, a distance from the left end surface to the right end surface of the first rectangular cavity is 0.6λ, a distance from the upper end surface to the lower end surface of the first rectangular cavity is 0.3λ, a distance from the left end surface to the right end surface of the first rectangular bar is 0.1λ, and a distance from the upper end surface to the lower end surface of the first rectangular bar is 0.1λ; a distance from the front end surface to the rear end surface of the second rectangular cavity is 0.6λ, a distance from the left end surface to the right end surface of the second rectangular cavity is 0.4λ, and a distance from the upper end surface to the lower end surface of the second rectangular cavity is 0.3λ;

a first rectangular matching plate and a second rectangular matching plate are arranged in the second rectangular cavity, a left side wall of the first rectangular matching plate and a left side wall of the second rectangular cavity are attached together and are formed and connected integrally, a distance from a front end surface of the first rectangular matching plate to a front end surface of the second rectangular cavity is equal to a distance from a rear end surface of the first rectangular matching plate to a rear end surface of the second rectangular cavity, a distance from a left end surface to a right end surface of the first rectangular matching plate is 0.1λ, a distance from a front end surface to a rear end surface of the first rectangular matching plate is 0.2λ, an upper end surface of the first rectangular matching plate is located on the same plane as the upper end surface of the second rectangular cavity, a lower end surface of the first rectangular matching plate is located on the same plane as the lower end surface of the second rectangular cavity, and the second rectangular matching plate and the first rectangular matching plate are symmetrical left and right with respect to a left-right bisecting plane of the second rectangular cavity;

a distance from the front end surface to the rear end surface of the third rectangular cavity is 0.4λ, a distance from the left end surface to the right end surface of the third rectangular cavity is 0.2λ, a distance from the upper end surface to the lower end surface of the third rectangular cavity is 0.1λ, a third rectangular matching plate is arranged in the third rectangular cavity, a left side wall of the third rectangular matching plate and a left side wall of the third rectangular cavity are attached together and are formed and connected integrally, a distance from a front end surface of the third rectangular matching plate to the front end surface of the third rectangular cavity is equal to a distance from a rear end surface of the third rectangular matching plate to the rear end surface of the third rectangular cavity, an upper end surface of the third rectangular matching plate is located on the same plane as the upper end surface of the third rectangular cavity, a lower end surface of the third rectangular matching plate is located on the same plane as the lower end surface of the third rectangular cavity, a distance from a left end surface to a right end surface of the third rectangular matching plate is 0.1λ, a distance from a front end surface to a rear end surface of the third rectangular matching plate is 0.2λ, the upper end surface of the first rectangular cavity is used as an output terminal of the first radiation assembly, and the lower end surface of the third rectangular cavity is used as an input terminal of the first radiation assembly;

if the first radiation assembly on the left is moved downwards by 0.9λ and is then rotated clockwise by 180° around the center line, the first radiation assembly on the left will overlap with the second radiation assembly on the left; if the first radiation assembly on the right is moved downwards by 0.9λ and is then rotated clockwise by 180° around the center line, the first radiation assembly on the right will overlap with the second radiation assembly on the right;

the input terminals of the two first radiation assemblies and input terminals of the two second radiation assemblies are used as four input terminals of the radiation unit; the four input terminals of each radiation unit are used as four input terminals of the radiation layer, and the radiation layer has $4*n^2$ input terminals; the output terminals of the two first radiation assemblies and output terminals of the two second radiation assemblies are used as four output terminals of the radiation unit, the four output terminals of each radiation unit are used as four output terminals of the radiation layer, and the radiation layer has $4*n^2$ output terminals.

2. The low-sidelobe plate array antenna comprises a radiation layer and a feed layer according to claim 1, wherein the feed layer comprises a second plate, $$\left(\frac{n}{2^1}\right)^2$$

first-level H-type E-plane waveguide power division network units and a standard waveguide input port, wherein the $$\left(\frac{n}{2^1}\right)^2$$

first-level H-type E-plane waveguide power division network units and the standard waveguide input port are disposed on the second plate, and the second plate is a rectangular plate; each first-level H-type E-plane waveguide power division network unit comprises a first-level H-type E-plane waveguide power division network and a second-level H-type E-plane waveguide power divider, wherein the first-level H-type E-plane waveguide power division network comprises two first H-type E-plane waveguide power division networks and two second H-type E-plane waveguide power division networks, the two first H-type E-plane waveguide power division networks are parallelly arranged left and right and are spaced apart from each other, the first H-type E-plane waveguide power division network on the left will overlap with the first H-type E-plane waveguide power division network on the right after being moved rightwards by 1.8λ, the two second H-type E-plane waveguide power division networks are arranged left and right and are spaced apart from each other, the second H-type E-plane waveguide power division network on the left will overlap with the second H-type E-plane waveguide power division network on the right after being moved rightwards by 1.8λ, the two second H-type E-plane waveguide power division networks are located behind the two first H-type E-plane waveguide power division networks, a center distance between the second H-type E-plane waveguide power division network on the left and the first H-type E-plane waveguide power division network on the left is 1.8λ, the second H-type E-plane waveguide power division network on the left and the first H-type E-plane waveguide power division network on the left are symmetrical front and back, a center distance between the second H-type E-plane waveguide power division network on the right and the first H-type E-plane waveguide power division network on the right is 1.8λ, and the second H-type E-plane waveguide power division network on the right and the first H-type E-plane waveguide power division network on the right are symmetrical front and back;

each first H-type E-plane waveguide power division network comprises a first-level H-type E-plane waveguide power divider and four E-plane rectangular waveguide-single ridge waveguide transducers, wherein the first-level H-type E-plane waveguide power divider has an input terminal and four output terminals, divides a signal input via the input terminal thereof into four signals with the same power and phase, and outputs the four signals via the four output terminals thereof respectively, each E-plane rectangular waveguide-single ridge waveguide transducer has an input terminal and an output terminal and is used to convert a rectangular waveguide accessed to the input terminal thereof into a single ridge waveguide and output the single ridge waveguide via the output terminal thereof, the input terminals of the four E-plane rectangular waveguide-single ridge waveguide transducers are connected to the four output terminals of the first-level H-type E-plane waveguide power divider in a one-to-one correspondence, the input terminal of the first-level H-type E-plane waveguide power divider is used as an input terminal of the first H-type E-plane waveguide power division network, the output terminal of each E-plane rectangular waveguide-single ridge waveguide transducer is used as an output terminal of the first H-type E-plane waveguide power division network, and the first H-type E-plane waveguide power division network has one input terminal and four output terminals;

the input terminals of the two first H-type E-plane waveguide power division networks and input terminals of the two second H-type E-plane waveguide power division networks are used as input terminals of the first-level H-type E-plane waveguide power division network, four output terminals of each of the two first H-type E-plane waveguide power division networks and four output terminals of each of the two second H-type E-plane waveguide power division networks are used as output terminals of the first-level H-type E-plane waveguide power division network, and the first-level H-type E-plane waveguide power division network has four input terminals and sixteen output terminals;

the second-level H-type E-plane waveguide power divider has an input terminal and four output terminals and is used to divide a signal input via the input terminal thereof into four signals with the same power and phase and output the four signals via the four output terminals thereof respectively, the input terminal of the second-level H-type E-plane waveguide power divider is used as an input terminal of the first-level H-type E-plane waveguide power division network unit, the four output terminals of the second-level H-type E-plane waveguide power divider are connected to the four input terminals of the first-level H-type E-plane waveguide power division network in a one-to-one correspondence, the sixteen output terminals of the first-level H-type E-plane waveguide power division network are used as sixteen output terminals of the first-level H-type E-plane waveguide power division network unit, and the $$\left(\frac{n}{2^1}\right)^2$$

first-level H-type E-plane waveguide power division network units have $$16*\left(\frac{n}{2^1}\right)^2$$

output terminals, and the $$16*\left(\frac{n}{2^1}\right)^2$$

output terminals of the $$\left(\frac{n}{2^1}\right)^2$$

first-level H-type E-plane waveguide power division network units are used as $$16*\left(\frac{n}{2^1}\right)^2$$

output terminals of the teed layer and are connected to the $4*n^2$ input terminals of the radiation layer in a one-to-one correspondence; the $$\left(\frac{n}{2^1}\right)^2$$

first-level H-type E-plane waveguide power division network units are regularly distributed in $$\frac{n}{2^1}$$

rows and $$\frac{n}{2^1}$$

columns at intervals to form a first-level feed network array, a center distance between every two adjacent first-level H-type E-plane waveguide power division network units in each row is 3.6λ, and a center distance between every two adjacent first-level H-type E-plane waveguide power division network units in each column is 3.6λ;

from the first row and the first column of the first-level feed network array, the four first-level H-type E-plane waveguide power division network units in every two rows and every two columns form a first-level network unit group, and the first-level feed network array totally includes $$\left(\frac{n}{2^2}\right)^2$$

first-level network unit groups;

a third-level H-type E-plane waveguide power divider is disposed in each first-level network unit group, has an input terminal and four output terminals, and is used to divide a signal input via the input terminal thereof into four signals with the same power and phase via the four output terminals thereof respectively, the four output terminals of the third-level H-type E-plane waveguide power divider are connected to the input terminals of the four first-level H-type E-plane waveguide power division network units in the first-level network unit group in a one-to-one correspondence, the first-level network unit group and the third-level H-type E-plane waveguide power divider connected thereto form a second-level H-type E-plane waveguide power division network unit, the input terminal of the third-level H-type E-plane waveguide power divider is used as an input terminal of the second-level H-type E-plane waveguide power division network unit, $$\left(\frac{n}{2^2}\right)^2$$

second-level H-type E-plane waveguide power division network units which are distributed in $$\frac{n}{2^2}$$

rows and $$\frac{n}{2^2}$$

columns are obtained in total, and the $$\left(\frac{n}{2^2}\right)^2$$

second-level H-type E-plane waveguide power division network units form a second-level feed network array;

from the first row and the first column of the second-level feed network array, the four second-level H-type E-plane waveguide power division network units in every two rows and every two columns form a second-level network unit group, the second-level feed network array totally includes $$\left(\frac{n}{2^3}\right)^2$$

second-level network unit groups, the input terminal of the third-level H-type H-plane waveguide power divider of each second-level H-type E-plane waveguide power division network unit in the second-level network unit group is used as an input terminal of the second-level network unit group, and the second-level network unit group has four input terminals; a fourth-level H-type E-plane waveguide power divider is disposed in each second-level network unit group, has an input terminal and four output terminals, and is used to divide a signal input via the input terminal thereof into four output signals with the same power and phase and output the four signals via the four output terminals thereof respectively, the four output terminals of the fourth-level H-plane E-plane waveguide power divider are connected to the four input terminals of the second-level network unit group in a one-to-one correspondence, the second-level network unit group and the fourth-level H-type E-plane waveguide power divider connected thereto form a third-level H-type E-plane waveguide power division network unit, the input terminal of the fourth-level H-type E-plane waveguide power divider is used as an input terminal of the third-level H-type E-plane waveguide power division network unit, $$\left(\frac{n}{2^3}\right)^2$$

third-level H-type E-plane waveguide power division network units which are distributed in $$\frac{n}{2^3}$$

rows and $$\frac{n}{2^3}$$

columns are obtained in total, and the $$\left(\frac{n}{2^3}\right)^2$$

third-level H-type E-plane waveguide power division network units form a third-level feed network array;

by this analogy, a $(k-2)^{th}$-level feed network array is formed by $$\left(\frac{n}{2^{k-2}}\right)^2$$

$(k-2)^{th}$-level H-type E-plane waveguide power division network units, a $(k-1)^{th}$-level H-type E-plane waveguide power divider is arranged among the four $(k-2)^{th}$-level H-type E-plane waveguide power division network units in the $(k-2)^{th}$-level feed network array, has an input terminal and four output terminals, and is used to divide a signal input via the input terminal thereof into four signals with the same power and phase and output the four signals via the output terminals thereof respectively, the four output terminals of the $(k-1)^{th}$-level H-type E-plane waveguide power divider are connected to the input terminals of the four $(k-2)^{th}$-level H-type E-plane waveguide power division network units in a one-to-one correspondence, the input terminal of the $(k-1)^{th}$-level H-type E-plane waveguide power divider is connected to the standard waveguide input port which is used as an input terminal of the feed layer, and the input terminal of the feed layer is connected to an external signal interface;

the first-level H-type E-plane waveguide power divider comprises a first conversion block, a second conversion block, a third conversion block, a fourth conversion block, a fifth conversion block, a sixth conversion block, a first rectangular block, a first metal block, a second metal block and a third metal block, wherein an upper end surface of the first conversion block, an upper end surface of the second conversion block, an upper end surface of the third conversion block, an upper end surface of the fourth conversion block, an upper end surface of the fifth conversion block, an upper end surface of the sixth conversion block, an upper end surface of the first rectangular block, an upper end surface of the first metal block, an upper end surface of the second metal block and an upper end surface of the third metal block are located on the same plane as an upper end surface of the second plate; a lower end surface of the first conversion block, a lower end surface of the second conversion block, a lower end surface of the third conversion block, a lower end surface of the fourth conversion block, a lower end surface of the fifth conversion block, a lower end surface of the sixth conversion block, a lower end surface of the first rectangular block, a lower end surface of the first metal block, a lower end surface of the second metal block and a lower end surface of the third metal block are located on the same plane as a lower end surface of the second plate;

the first metal block is a parallelogram block, a front end surface of the first metal block is parallel to a front end surface of the second plate, a left end surface of the first metal block will be parallel to a left end surface of the second plate after the first metal block is rotated anticlockwise by 22.5° around a center thereof, a length of the front end surface of the first metal block in the left-right direction is 0.1λ, a length of the front end surface of the first metal block in the front-back direction is 0.5λ, a length of the first metal block in the vertical direction is 0.8λ, and the first metal block will overlap with the second metal block after being moved rightwards by 0.9λ;

the third metal block is located between the first metal block and the second metal block and is a parallelogram block, a front end surface of the third metal block will be parallel to the front end surface of the second plate after the third metal block is rotated clockwise by 12.5° around a center thereof, and a length of the front end surface of the third metal block in the left-right direction is 0.6λ;

the first conversion block comprises a second rectangular block and a first right triangle block, a left end surface of the second rectangular block serves as a left end surface of the first conversion block, the left end surface of the first conversion block is connected and attached to a right end surface of the first metal block, a length of a front end surface of the second rectangular block in the left-right direction is 0.1λ, a length of the left end surface of the second rectangular block in the front-back direction is 0.2λ, a distance from the front end surface of the second rectangular block to a front end surface of the first metal block will be equal to a distance from a rear end surface of the second rectangular block to a rear end surface of the first metal block after the second rectangular block is rotated anticlockwise by 22.5° around a center thereof, an end surface, where a first right-angle side of the first right triangle block is located, is connected and attached to a right end surface of the second rectangular block, a length of the end surface, where the first right-angle side of the first right triangle block is located, in the front-back direction is equal to a length of the left end surface of the second rectangular block in the front-back direction, an end surface, where a second right-angle side of the first right triangle block is located, is located on the same plane as the rear end surface of the second rectangular block, an included angle between the end surface where the first right-angle side of the first right triangle block is located and an end surface where a hypotenuse of the first right triangle block is located is 22.5°, and the end surface, where the hypotenuse of the first right triangle block is located, is connected to and entirely overlaps with a left end surface of the third metal block;

the second conversion block comprises a third rectangular block and a second right triangle block, wherein a right end surface of the third rectangular block serves as a right end surface of the second conversion block, the right end surface of the second conversion block is connected and attached to a left end surface of the second metal block, a length of a front end surface of the third rectangular block in the left-right direction is 0.1λ, a length of the right end surface of the third rectangular block in the front-back direction is 0.2λ, a distance from the front end surface of the third rectangular block to a front end surface of the second metal block is equal to a distance from a rear end surface of the third rectangular block to a rear end surface of the second metal block after the third rectangular block is rotated anticlockwise by 22.5° around a center thereof, an end surface, where a first right-angle side of the second right triangle block is located, is connected and attached to a left end surface of the third rectangular block, a length of the end surface, where the first right-angle side of the second right triangle block is located, in the front-back direction is equal to a length of the left end surface of the third rectangular block in the front-back direction, an end surface, where a second right-angle side of the second right triangle block is located, is located on the same plane as the front end surface of the third rectangular block, an included angle between the end surface where the second right-angle side of the second right triangle block is located and an end surface where a hypotenuse of the second right triangle block is located is 22.5°, and the end surface, where the hypotenuse of the second right triangle block is located, will be connected to and entirely overlap with a right end surface of the third metal block;

the third conversion block comprises a fourth rectangular block and a third right triangle block, wherein a front end surface of the fourth rectangular block serves as a front end surface of the third conversion block, a length of the front end surface of the fourth rectangular block in the left-right direction is 0.1λ, an end surface, where a first right-angle side of the third right triangle block is located, entirely overlaps with a rear end surface of the fourth rectangular block, a length of the end surface, where the first right-angle side of the third right triangle block is located, is equal to a length of the rear end surface of the fourth rectangular block in the left-right direction, an end surface, where a second right-angle side of the third right triangle block is located, is located on the same plane as a right end surface of the fourth rectangular block, an included angle between the end surface where the first right-angle side of the third right triangle block is located and an end surface where a hypotenuse of the third right triangle block is located is 22.5°, the end surface, where the hypotenuse of the third right triangle block is located, will be connected to and entirely overlap with the front end surface of the first metal block, the third conversion block will entirely overlap with the fourth conversion block after being moved rightwards by 0.9λ, and the rear end surface of the fourth conversion block is connected to and entirely overlaps with the front end surface of the second metal block;

the fifth conversion block is symmetrical with the third conversion block in the front-back direction, and a front end surface of the fifth conversion block is connected to and entirely overlaps with the rear end surface of the first metal block;

the sixth conversion block is symmetrical with the fourth conversion block in the front-back direction, a front end surface of the sixth conversion block is connected to and entirely overlaps with the rear end surface of the second metal block, the front end surface of the third conversion block, the front end surface of the fourth conversion block, a rear end surface of the fifth conversion block and a rear end surface of the sixth conversion block are used as the fourth output terminals of the first-level H-type E-plane waveguide power divider respectively, the front end surface of the first rectangular block is connected and attached to the rear end surface of the third metal block, a length of the first rectangular block in the left-right direction is 0.6λ, a distance from a left end of the front end surface of the first rectangular block to a left end of the rear end surface of the third metal block is equal to a distance from a right end of the front end surface of the first rectangular block to a right end of the rear end surface of the third metal block, and the rear end surface of the first rectangular block is used as the input terminal of the first-level H-type E-plane waveguide power divider.

3. The low-sidelobe plate array antenna comprises a radiation layer and a feed layer according to claim 2, wherein the E-plane rectangular waveguide-single ridge waveguide transducer comprises a first rectangular metal block, wherein a rectangular port and a fourth rectangular cavity are formed in the first rectangular metal block, a rear end surface of the rectangular port is used as an input terminal of the E-plane rectangular waveguide-single ridge waveguide transducer, an upper end surface of the rectangular port is spaced apart from an upper end surface of the first rectangular metal block by a certain distance, a rear end surface of the rectangular port is located on the same plane as a rear end surface of the first rectangular metal block, an upper end surface of the fourth rectangular cavity is located on the same plane as the upper end surface of the first rectangular metal block, a left end surface of the fourth rectangular cavity is located on the same plane as a left end surface of the rectangular port, a rear end surface of the fourth rectangular cavity is connected and attached to a front end surface of the rectangular port, a lower end surface of the fourth rectangular cavity is located on the same plane as a lower end surface of the rectangular port, a right end surface of the rectangular port is spaced apart from a right end surface of the fourth rectangular cavity by a certain distance, the right end surface of the fourth rectangular cavity is spaced apart from a right end surface of the first rectangular metal block by a certain distance, a distance from the left end surface of the fourth rectangular cavity to the left end surface of the first rectangular metal block is equal to a distance from the right end surface of the fourth rectangular cavity to the right end surface of the first rectangular metal block, the lower end surface of the fourth rectangular cavity is spaced apart from the lower end surface of the first rectangular metal block by a certain distance, a single ridge step, an H-plane step and an E-plane step are arranged in the fourth rectangular cavity and are all rectangular blocks, a front end surface of the single ridge step, a front end surface of the H-plane step and a front end surface of the E-plane step are connected and attached to the front end surface of the fourth rectangular cavity, a left end surface of the H-plane step is connected and attached to the left end surface of the fourth rectangular cavity, a lower end surface of the H-plane step is connected and attached to the lower end surface of the fourth rectangular cavity, a right end surface of the H-plane step is connected and attached to a left end surface of the single ridge step, a lower end surface of the single ridge step is connected and attached to the lower end surface of the fourth rectangular cavity, an upper end surface of the single ridge step is located on the same plane as the upper end surface of the fourth rectangular cavity, a right end surface of the single ridge step is connected and attached to a left end surface of the E-plane step, a right end surface of the E-plane step is connected and attached to the right end surface of the fourth rectangular cavity, and a lower end surface of the E-plane step is connected and attached to the lower end surface of the fourth rectangular cavity;

a length of the H-plane step in the front-back direction is half of a length of the fourth rectangular cavity in the front-back direction, a length of the H-plane step in the left-right direction is one third of a length of the fourth rectangular cavity in the left-right direction, a length of the H-plane step in the vertical direction is two fifths of a length of the fourth rectangular cavity in the vertical direction, a length of the single ridge step in the front-back direction is half of a length of the fourth rectangular cavity in the front-back direction, a length of the single ridge step in the left-right direction is one third of a length of the fourth rectangular cavity in the left-right direction, a length of the single ridge step in the vertical direction is equal to a length of the fourth rectangular cavity in the vertical direction, a length of the E-plane step in the front-back direction is equal to a length of the fourth rectangular cavity in the front-back direction, a length of the E-plane step in the left-right direction is one third of a length of the fourth rectangular cavity in the left-right direction, a length of the E-plane step in the vertical direction is a quarter of a length of the fourth rectangular cavity in the vertical direction, and the upper end surface of the fourth rectangular cavity serves as the output terminal of the E-plane rectangular waveguide-single ridge waveguide transducer.

* * * * *